US011506366B2

(12) United States Patent
Sharrah et al.

(10) Patent No.: US 11,506,366 B2
(45) Date of Patent: Nov. 22, 2022

(54) MOUNTABLE LIGHT HAVING INTERCHANGEABLE CLAMPING ELEMENTS

(71) Applicant: STREAMLIGHT, INC., Eagleville, PA (US)

(72) Inventors: Raymond L. Sharrah, Collegeville, PA (US); William D. Worman, Phoenixville, PA (US)

(73) Assignee: STREAMLIGHT, INC., Eagleville, PA (US)

( * ) Notice: Subject to any disclaimer, the term of this patent is extended or adjusted under 35 U.S.C. 154(b) by 0 days.

(21) Appl. No.: 17/394,101

(22) Filed: Aug. 4, 2021

(65) Prior Publication Data

US 2022/0042675 A1 Feb. 10, 2022

Related U.S. Application Data

(60) Provisional application No. 63/062,638, filed on Aug. 7, 2020.

(51) Int. Cl.
*F21V 21/088* (2006.01)
*F41G 11/00* (2006.01)

(52) U.S. Cl.
CPC ..... *F21V 21/0885* (2013.01); *F41G 11/004* (2013.01)

(58) Field of Classification Search
CPC ..... F41G 11/004; F41G 1/34; F41G 1/345; F41G 1/35; F41G 1/36; F21V 21/0885; F21V 21/088
See application file for complete search history.

(56) References Cited

U.S. PATENT DOCUMENTS 2,546,242 A 3/1951 Stinson
2,597,565 A 5/1952 Chandler et al.
(Continued)

FOREIGN PATENT DOCUMENTS

DE 202004003173 9/2004
EP 1817521 9/2013
(Continued)

OTHER PUBLICATIONS

International Searching Authority, "PCT—International Search Report & Written Opinion", PCT/US2021/044700, dated Nov. 9, 2021, 15 pages.

(Continued)

*Primary Examiner* — Jong-Suk (James) Lee
*Assistant Examiner* — James M Endo
(74) *Attorney, Agent, or Firm* — Clement A. Berard, Esq.; Dann, Dorfman, Herrell & Skillman, PC

(57) ABSTRACT

A mountable light includes a light body and a mounting arrangement including first and second clamping members from a set of pairs of clamping members. The light body has first and second opposing receptacles in which the respective clamping members are respectively removably disposed to move toward and away from each other. One clamping member may be fastened in its receptacle so as to be a fixed clamping member while the other clamping member is movable. A clamping mechanism may move the clamping members closer together to engage a mounting rail or away from each other to release the rail. An interchangeable key member may be provided between the clamping members, and may be selected from a set of interchangeable key members.

22 Claims, 8 Drawing Sheets

(56) References Cited

U.S. PATENT DOCUMENTS 2,601,613 A 6/1952 Jahncke
2,743,526 A 5/1956 Ivy
3,153,856 A 10/1964 Felix
3,488,488 A 1/1970 Crouch
3,512,290 A 5/1970 La Violette, Jr.
3,513,581 A 5/1970 Slater
3,877,166 A 4/1975 Ward
3,986,285 A 10/1976 Krisay
4,177,754 A 12/1979 James et al.
4,359,277 A 11/1982 Shimizu et al.
4,489,366 A 12/1984 Rozniecki
4,580,362 A 4/1986 Stevens
4,697,226 A 9/1987 Verdin
4,703,576 A 11/1987 Burris
4,707,772 A 11/1987 Jimenez et al.
4,856,218 A 8/1989 Reynolds, Jr.
4,939,863 A 7/1990 Alexander et al.
5,042,186 A 8/1991 Bechtel
5,180,220 A 1/1993 Van Kalsbeek
5,285,038 A 2/1994 Asher et al.
5,400,540 A 3/1995 Solsinsky et al.
5,422,798 A 6/1995 Osiecki et al.
5,430,967 A 7/1995 Woodman, III et al.
5,522,167 A 6/1996 Teetzel
5,581,898 A 12/1996 Thummel
5,584,137 A 12/1996 Teetzel
5,628,555 A 5/1997 Sharrah et al.
5,669,173 A 9/1997 Rodney, Jr.
5,685,105 A 11/1997 Teetzel
5,758,448 A 6/1998 Thummel
5,787,628 A 8/1998 Teetzel
5,816,683 A 10/1998 Christiansen
5,913,669 A 6/1999 Hansen et al.
6,073,901 A 6/2000 Richter
6,115,952 A 9/2000 Rigler
6,154,995 A 12/2000 Lenoir
6,185,854 B1 2/2001 Solinsky et al.
6,230,431 B1 5/2001 Bear
6,276,088 B1* 8/2001 Matthews ..... F41G 1/35 42/1.03
6,283,609 B1 9/2001 Parsons et al.
6,283,611 B1 9/2001 Sharrah
6,295,754 B1 10/2001 Ottem an et al.
6,296,367 B1 10/2001 Parsons et al.
6,378,237 B1 4/2002 Matthews
6,425,561 B2 7/2002 Wooten et al.
6,574,901 B1 6/2003 Solinsky et al.
6,609,810 B2 8/2003 Kim
6,612,714 B1 9/2003 Morre et al.
6,733,153 B1 5/2004 Lee
6,764,194 B1 7/2004 Cooper
6,874,269 B2 4/2005 Chen et al.
7,117,624 B2 10/2006 Kim
7,188,978 B2 3/2007 Sharrah et al.
D542,446 S 5/2007 DiCarlo
D543,446 S 5/2007 DiNenna
D548,385 S 8/2007 Sharrah et al.
7,260,912 B2 8/2007 Liu
7,325,352 B2 2/2008 Matthews et al.
D567,894 S 4/2008 Sterling
7,357,534 B2 4/2008 Snyder
D568,508 S 5/2008 Howe et al.
D578,599 S 10/2008 Cheng
7,614,760 B2 11/2009 Sharrah et al.
D612,970 S 3/2010 Sharrah et al.
7,726,061 B1* 6/2010 Thummel ..... F41G 1/35 42/117
7,735,255 B1 6/2010 Kincaid
7,934,333 B1 5/2011 Tuz
8,169,165 B2 5/2012 West
8,226,267 B2 7/2012 Sharrah et al.
8,256,154 B2 9/2012 Danielson
8,287,157 B2 10/2012 Sharrah et al.
D673,709 S 1/2013 Sharrah
D674,525 S 1/2013 Sharrah et al.
D674,858 S 1/2013 Galli
8,371,729 B2 2/2013 Sharrah et al.
8,510,979 B1 8/2013 Mortimer
8,683,731 B2 4/2014 Kowalczyk
8,683,733 B2 4/2014 Gross
8,690,377 B2 4/2014 Weber
8,713,844 B2 5/2014 Tuller, Jr.
8,760,085 B2 6/2014 West
D709,981 S 7/2014 Johnston
D712,001 S 8/2014 Wells
8,807,781 B2 8/2014 Weber
8,904,698 B2 12/2014 Riley
8,915,009 B2 12/2014 Caulk
9,035,576 B2 5/2015 West
D732,134 S 6/2015 Wells
D738,455 S 9/2015 Homem de Mello Anderson
D738,457 S 9/2015 Johnston
9,182,194 B2 11/2015 Moore
D757,311 S 5/2016 Nagano
9,341,440 B2 5/2016 Moore
9,488,439 B2 11/2016 Galli
D781,983 S 3/2017 Wells
9,658,031 B1 5/2017 Hedeen
D790,097 S 6/2017 Port
D796,622 S 9/2017 Sharrah
9,772,163 B2 9/2017 Sharrah et al.
D800,362 S 10/2017 Galli
9,810,411 B2 11/2017 Galli et al.
9,841,258 B1 12/2017 Galli et al.
D807,981 S 1/2018 Cheng et al.
9,874,337 B2 1/2018 Galli et al.
D812,178 S 3/2018 Galli
D813,340 S 3/2018 Galli
9,958,143 B2 5/2018 Galli et al.
D829,841 S 10/2018 Galli
10,107,592 B1* 10/2018 Huang ..... F41G 11/003
10,344,959 B2 7/2019 Worman et al.
10,365,069 B1* 7/2019 Tayon ..... F41G 11/003
D857,268 S 8/2019 Worman
D857,960 S 8/2019 Worman
D872,334 S 1/2020 Fan
D885,510 S 5/2020 Wells
10,697,623 B2 6/2020 Worman
D898,260 S 10/2020 Worman
D898,261 S 10/2020 Worman
D907,267 S 1/2021 Worman
D907,268 S 1/2021 Worman
D907,269 S 1/2021 Worman
D907,270 S 1/2021 Worman
2002/0100204 A1 8/2002 Kim
2002/0148153 A1 10/2002 Thorpe
2003/0007355 A1 1/2003 Leen
2003/0179572 A1 9/2003 Schnell
2004/0068913 A1 4/2004 Solinsky et al.
2004/0132342 A1 7/2004 Lien
2004/0169119 A1 9/2004 Crowell et al.
2005/0068766 A1 3/2005 Sharrah et al.
2005/0246937 A1 11/2005 Kim
2005/0270773 A1 12/2005 Arthur
2006/0083008 A1 4/2006 Yu
2006/0083009 A1 4/2006 Hsu
2006/0104064 A1* 5/2006 Sharrah ..... H05K 1/147 362/396
2006/0196099 A1 9/2006 Matthews et al.
2007/0006512 A1 1/2007 Williams et al.
2007/0147042 A1 6/2007 Sharrah et al.
2007/0277422 A1* 12/2007 Ding ..... F41G 11/003 42/146
2008/0040965 A1* 2/2008 Solinsky ..... F41G 1/345 42/90
2008/0120891 A1 5/2008 Wei
2008/0202010 A1* 8/2008 Matthews ..... F41G 1/35 42/115
2009/0013580 A1 1/2009 Houde-Walter et al.
2010/0091485 A1 4/2010 Matthews et al.
2010/0097789 A1 4/2010 Sharrah
2010/0176741 A1* 7/2010 Sharrah ..... F21V 21/0885 362/382
2011/0058362 A1 3/2011 Sun et al.

(56) References Cited

U.S. PATENT DOCUMENTS

| | | | | |
|---|---|---|---|---|
| 2011/0214973 | A1 | 9/2011 | Solinsky et al. | |
| 2011/0290968 | A1* | 12/2011 | Maughan | F41G 11/004 248/231.51 |
| 2012/0124885 | A1 | 5/2012 | Caulk | |
| 2012/0144718 | A1 | 6/2012 | Danielson | |
| 2012/0167436 | A1* | 7/2012 | Westra | F41G 11/004 42/90 |
| 2013/0074351 | A1 | 3/2013 | Kowalczyk | |
| 2013/0145672 | A1 | 6/2013 | Tuller | |
| 2015/0102743 | A1 | 4/2015 | West | |
| 2015/0103517 | A1 | 4/2015 | Maglica | |
| 2015/0113851 | A1 | 4/2015 | Bensayan | |
| 2015/0159847 | A1* | 6/2015 | Galli | F21V 29/70 362/111 |
| 2015/0192391 | A1 | 7/2015 | Moore | |
| 2015/0233668 | A1 | 8/2015 | Moore | |
| 2015/0276347 | A1* | 10/2015 | Sharrah | F41G 1/35 42/117 |
| 2015/0276352 | A1 | 10/2015 | Chang et al. | |
| 2016/0021329 | A1 | 1/2016 | Sakiewicz | |
| 2016/0169483 | A1 | 6/2016 | Sharrah et al. | |
| 2016/0209167 | A1 | 7/2016 | Wells | |
| 2016/0209168 | A1 | 7/2016 | Sharrah et al. | |
| 2016/0305742 | A1 | 10/2016 | Kowalcazyk | |
| 2017/0268849 | A1* | 9/2017 | Conner | F21V 33/0076 |
| 2018/0087757 | A1* | 3/2018 | Mock | F21V 15/01 |
| 2018/0087876 | A1* | 3/2018 | Galli | F41G 1/35 |
| 2018/0283670 | A1* | 10/2018 | Galli | F41G 11/003 |
| 2019/0154243 | A1* | 5/2019 | Worman | F21V 7/0075 |
| 2019/0234710 | A1 | 8/2019 | Batenhorst et al. | |
| 2019/0301835 | A1 | 10/2019 | Tayon | |
| 2019/0316882 | A1 | 10/2019 | Galli | |
| 2020/0158473 | A1 | 5/2020 | Wells et al. | |
| 2020/0173640 | A1 | 6/2020 | Worman et al. | |

FOREIGN PATENT DOCUMENTS

| | | | |
|---|---|---|---|
| EP | 3045857 | 7/2016 | |
| JP | 1995119715 | 5/1995 | |
| JP | 1998069807 | 3/1998 | |
| WO | 2000/077470 | 12/2000 | |
| WO | 2006/055439 | 5/2006 | |
| WO | 2010/083138 | 7/2010 | |
| WO | WO-2010083138 A1 * | 7/2010 | F21V 21/0885 |

OTHER PUBLICATIONS

Streamlight, Inc., "Product Catalog," Jun. 2001, Front Cover, pp. 1, 8-11, 28-29, 32-33, Rear Cover.

Streamlight, Inc., "M2 Universal Tactical Light," Product Package, Prior to Oct. 24, 2006, 1 Pg.

Streamlight, Inc., "M2 Universal Tactical Light," Operator's Manual, Oct. 2003, 2 Pages.

Streamlight, Inc., "M-3 LED Tactical Navigation Light," Dated: 2002, Eagleville, PA, 2 Pages.

Streamlight, Inc., "M-6 Tactical Laser Illuminator," Dated 2003, Eagleville, PA, 2 Pages.

Streamlight, Inc., "Introducing the All-New MIL-SPEC X-Series—Trusted Tactical Lights Taken to the X-treme," Dated: Oct. 2003, Eagleville, PA, 2 Pages.

Streamlight, Inc., "L.A.M. Laser Aiming Module," Dated 2000, Eagleville, PA, 2 Pages.

Streamlight, Inc., "Tactical Series Specifications," http://www.streamlight.com/tactical_specifications.htm, Printed Oct. 28, 2004, 3 Pages.

Streamlight, Inc., "Tactical Series Parts & Accessories," Specifications, http://www.streamlight.com/tactical_accessories.htm, Printed Oct. 28, 2004, 2 Pages.

Streamlight, Inc., Streamlight M-3 LED, Streamlight Products, http://www.streamlight.com/m3led_specs.htm, Printed Oct. 28, 2004, 1 Page.

Streamlight, Inc., Streamlight M-6, M-6 Tactical Laser Illuminator Specifications, http://www.streamlight.com/m6_specifications.htm, Printed Oct. 28, 2004, 1 Page.

Streamlight, Inc., "Streamlight Laser Aiming Module (L.A.M.)," Streamlight Products, http://www.streamlight.com/lam_specs.htm, Printed Oct. 28, 2004, 2 Pages.

Streamlight, Inc., "X-Series Specifications", http://www.streamlight.com/x-series_specs.htm, Printed Oct. 28, 2004, 2 Pages.

Streamlight, Inc., "Tactical Gun Mount Series—TLR-1", http://www.streamlight.com/product/product.aspx?pid=80, Printed Sep. 18, 2006, 1 Page.

Streamlight, Inc., "Tactical Gun Mount Series—TLR-2 With Laser Sight", http://www.streamlight.com/product/product.aspx?pid=81, Printed Sep. 18, 2006, 1 Page.

First Samco, "Tactical Light Holder," First Samco Tactical Accessories for AR15 & M/16, http://www.firstsamco.com/catalog/productdetail.php?ID=4, Printed Nov. 4, 2004, 1 Page.

First Samco, "Images for Tactical Light Holder," First Samco Tactical Accessories for AR15 & M/16, http://www.firstsamco.com/catalog/moreimages.php?ID=4, Printed Nov. 4, 2004, 1Pg.

Insight Technology, Inc., M2 UTL Universal Tactical Light (with Photos), © 2004, http://www.insightlights.com/products/showProduct.asp?id=1, Printed Nov. 8, 2005, 4 Pgs.

Insight Technology, Inc., "M3X Tactical Illuminator," © 2004, http://www.insightlights.com/products/showProduct.asp?id=6, Printed Oct. 28, 2004, 2 Pages.

Insight Technology, Inc., "M6 Tactical Illuminator (with Photos)," © 2004, http://www.insightlights.com/products/showProduct.asp?id=9, Printed Oct. 28, 2004, 5 Pages.

Insight Technology, Inc., "M6X Tactical Illuminator (with Photos)," © 2004 http://www.insightlights.com/products/showProduct.asp?id=11, Printed Oct. 28, 2004, 6 Pgs.

Insight Technology, Inc., "XML X-treme Mini Light", © 2004, http://www.insightlights.com/products/showProduct.asp?id=2, Printed Oct. 28, 2004, 1 Page.

Insight Technology, Inc., "Tactical Lights by Insight Technology Inc. (UTL, M3, LAM)—Products by Product Index", © 2001, http://www.insightlights.com/oldsite/prodbyproducts.htm, Printed Sep. 18, 2006, 1 Page.

Insight Technology, Inc., "Tactical Lights by Insight Technology Inc. (UTL, M3, LAM)—The M3 Tactical Light", © 2001, http://www.insightlights.com/oldsite/prod_m3.htm, Printed Sep. 18, 2006, 1 Page.

Insight Technology, Inc., "Tactical Lights by Insight Technology Inc. (UTL, M3, LAM)—M3 Photo Gallery", © 2001, http://www.insightlights.com/oldsite/gallery_m3.htm, Printed Sep. 18, 2006, 1 Page.

Insight Technology, Inc., "Tactical Lights by Insight Technology Inc. (UTL, M3, LAM)—The M3-LED Tactical Illuminator", © 2001, http://www.insightlights.com/oldsite/prod_m3led.htm, Printed Sep. 18, 2006, 2 Pages.

Insight Technology, Inc., "Tactical Lights by Insight Technology Inc. (UTL, M3, LAM)—M3-LED Photo Gallery", © 2001, http://www.insightlights.com/oldsite/gallery_m3led.htm, Printed Sep. 18, 2006, 1 Page.

Insight Technology, Inc., "Tactical Lights by Insight Technology Inc. (UTL, M3, LAM)—The M4 and M4-Pro Tactical Light", © 2001, http://www.insightlights.com/oldsite/prod_m4.htm, Printed Sep. 18, 2006, 1 Page.

Insight Technology, Inc., "Tactical Lights by Insight Technology Inc. (UTL, M3, LAM)—M4 & M4-Pro Photo Gallery", © 2001, http://www.insightlights.com/oldsite/gallery_m4.htm, Printed Sep. 18, 2006, 1 Page.

Insight Technology, Inc., "Tactical Lights by Insight Technology Inc. (UTL, M3, LAM)—The M5 Tactical Light", © 2001, http://www.insightlights.com/oldsite/prod_m5.htm, Printed Sep. 18, 2006, 1 Page.

Insight Technology, Inc., "Tactical Lights by Insight Technology Inc. (UTL, M3, LAM)—M5 Photo Gallery", © 2001, http://www.insightlights.com/oldsite/gallery_m5.htm, Printed Sep. 18, 2006, 1 Page.

(56) References Cited

OTHER PUBLICATIONS

Insight Technology, Inc., "Tactical Lights by Insight Technology Inc. (UTL, M3, LAM)—The M6 Tactical Laser Illuminator", © 2001, http://www.insightlights.com/oldsite/prod_m6.htm, Printed Sep. 18, 2006, 2 Pages.
Insight Technology, Inc., "Tactical Lights by Insight Technology Inc. (UTL, M3, LAM)—M6 Photo Gallery", © 2001, http://www.insightlights.com/oldsite/gallery_m6.htm, Printed Sep. 18, 2006, 1 Page.
Insight Technology, Inc., "Tactical Lights by Insight Technology Inc. (UTL, M3, LAM)—Laser Aiming Module (LAM)", © 2001, http://www.insightlights.com/oldsite/prod_lam.htm, Printed Sep. 18, 2006, 2 Pages.
Insight Technology, Inc., "Tactical Lights by Insight Technology Inc. (UTL, M3, LAM) LAM Photo Gallery", © 2001, http://www.insightlights.com/oldsite/gallery_lam.htm, Printed Sep. 18, 2006, 1 Page.
Insight Technology, Inc., "Tactical Lights by Insight Technology Inc. (UTL, M3, LAM) Parts & Accessories Photo Gallery", © 2001, Printed Sep. 18, 2006, 2 Pages, http://www.insightlights.com/oldsite/gallery_access.htm.
SureFire, "Laser Sights," Weapon mounted laser sights from SureFire, © 2001-2004, 1 page, http://www.surefire.com/maxexp/main/co_disp/displ/pgrfnbr/364/sesent/00, Printed Oct. 28, 2004.
SureFire, "Weapon Lights," Lights for weapons including handguns, shotguns, and rifles, © 2001-2004, http://www.surefire.com/maxexp/main/co_disp/displ/pgrfnbr/211/sesent/00, Printed Oct. 28, 2004, 1 Page.
SureFire, "Handgun Weapon Lights," Handgun Tactical WeaponLights provided by SureFire, © 2001-2004, http://www.surefire.com/maxexp/main/co_disp/displ/carfnbr/91/sesent/00, Printed Oct. 28, 2004, 2 Pages.
SureFire, "Products," X200 WeaponLight—X200 avalible from SureFire, © 2001-2004, http://www.surefire.com/maxexp/main.pl?pgm-co_disp&func-displ&strfnbr=6&prrfnbr=1110& . . . , Printed Oct. 28, 2004, 2 Pages.
SureFire, "SureFire Integrated Shotgun WeaponLights," Shotgun WeaponLights provided by SureFire, © 2001-2004, Printed Oct. 28, 2004, 1 Page, http://www.surefire.com/maxexp/main/co_disp/displ/carfnbr/92/sesent/00.
SureFire, "Rifle, Carbine & SMG Light Systems," Rifle, Carbine & SMG WeaponLights Systems provided by SureFire, © 2001-2004, Printed Oct. 28, 2004, 1 Page, http://www.surefire.com/maxexp/main/co_disp/displ/carfnbr/93/sesent/00.
SureFire, "Rifle, Carbine & SMG Light Systems," Millennium Forends provided by SureFire, © 2001-2004, Printed Oct. 28, 2004, 1 Page, http://www.surefire.com/maxexp/main/co_disp/displ/carfnbr/265/sesent/00.
SureFire, "Rifle, Carbine & SMG Light Systems," Millennium Universal WeaponLights provided by SureFire, © 2001-2004, Printed Oct. 28, 2004, 1 Page, http://www.surefire.com/maxexp/main/co_disp/displ/carfnbr/267/sesent/00.
SureFire, "Rifle, Carbine & SMG Light Systems," Millennium Vertical Foregrip System provided by SureFire, © 2001-2004, Printed Oct. 28, 2004, 1 Page, http://www.surefire.com/maxexp/main/co_disp/displ/carfnbr/266/sesent/00.
SureFire, "Rifle, Carbine & SMG Light Systems," Classic Series WeaponLights provided by SureFire, © 2001-2004, Printed Oct. 28, 2004, 1 Page, http://www.surefire.com/maxexp/main/co_disp/displ/carfnbr/271/sesent/00.
SureFire, "Weapon Mounts," SureFire Weapon Mounts, © 2001-2004, Printed Oct. 28, 2004, 1 Page, http://www.surefire.com/maxexp/main/co_disp/displ/pgrfnbr/378/sesent/00.
SureFire, "Products Weapon Mounts,"Picatinny forends provided by SureFire, © 2001-2004, http://www.surefire.com/maxexp/main/co_disp/displ/carfnbr/312/sesent/00, Printed Oct. 28, 2004, 1 Page.
SureFire, "Products Weapon Mounts," S.I.R. System C (Selective Integrated Rail)—M61 available from SureFire, © 2001-2004, Printed Oct. 28, 2004, 1 Page, http://www.surefire.com/maxexp/main/co_disp/displ/prrfnbr/824/sesent/00.
Falcon Tactical, "Sig Sauer Stoplite Vertical Grip with Weaponlight", http://www.falcontactical.net/sigsastvegrw.html, © 2006-2009, 2 pages.
Streamlight, Inc., "Tactical Gun Mount Series—TLR-1", http://streamlight.com/product/product.aspx?pid=80, Printed Mar. 9, 2009, 2 pages.
Insight Technology, Inc., "X-treme Functionality . . . XTI Procyon", © 2008, http://www.insightlights.com/products-procyon.htm, Printed Mar. 12, 2009, 1 page.
Insight Technology, Inc., "X-treme Design . . . X2", © 2008, http://www.insightlights.com/products-x2.htm, Printed Mar. 12, 2009, 1 page.
Insight Technology, Inc., "X2 Sub-Compact Operator Manual", Rev. Apr. 2005, 6 pages.
Laserlyte, "Sight TGL DB .380/9MM Tan", printed Jan. 13, 2015, 4 pages, http://www.laserlyte.com/products/sight-tgl-diamondback-380-9mm-tan.
Laserlyte, "Glock Lasers", printed Jan. 13, 2015, 1 page, http://www.laserlyte.com/collections/glock.
Laserlyte, "Springfield XD/XDM/XDS Lasers", printed Jan. 13, 2015, 1 page, http://www.laserlyte.com/collections/xd-xdm-xds.
Laserlyte, "SCCY Laser Sight", printed Jan. 13, 2015, 1 page, http://www.laserlyte.com/collections/sccy-laser-sight.
Laserlyte, "Hi-Point Laser", printed Jan. 13, 2015, 1 page, http://www.laserlyte.com/collections/hi-point-laser.
Laserlyte, "Closeouts", printed Jan. 13, 2015, 1 page, http://www.laserlyte.com/collections/discontinued-closeouts.
Laserlyte, "UTA-DB Diamondback Laser", Rev Aug. 2013, 2 pages.
Crimson Trace Corporation, "Crimson Trace CMR-202 Rail Master", Instruction Handbook, 27-1455 REV001 Apr. 2012, 2 pages.
European Patent Office, "European Search Report, EP Application No. 16150798", dated May 19, 2016, 8 pages.
Streamlight, Inc., "TLR-6 Subcompact Gun-Mounted Tactical Light With Integrated Red Aiming Laser", © 2016, 5 pages, www.streamlight.com.
Crimson Trace Corporation, "LTG-736 Lightguard for Glock Full-Size and Compact", © 2016, 3 pages, http://www.crimsontrace.com/.
Crimson Trace Corporation, "LG-452 Laserguard Green Laser Sight for Glock Full-Size and Compact", © 2016, 7 pages, http://www.crimsontrace.com/.
Crimson Trace Corporation, "DS-121 Defender Series Accuguard Laser Sight for Glock Full-Size and Compact", © 2016, 10 pages, http://www.crimsontrace.com/products/manufacturer/glock/01-5100.
Streamlight, Inc., "Modular Light Mountable on a Handgun", U.S. Appl. No. 15/283,788, filed Oct. 3, 2016, 61 pages.
Streamlight, Inc., "Mountable Light", Design U.S. Appl. No. 29/623,319, filed Oct. 24, 2017, 18 pages.
Streamlight, Inc., "Mountable Light", Design U.S. Appl. No. 29/623,320, filed Oct. 24, 2017, 18 pages.
Streamlight, Inc., "Portable and/or Mountable Light", U.S. Appl. No. 15/817,986, filed Nov. 20, 2017, 84 pages.
Streamlight, Inc., "TLR-1 HL Super Bright, 800 Lumen LED Tactical Weapon Light", Product Specifications, 2 pages., date prior to Oct. 24, 2017, www.streamlight.com.
Streamlight, Inc., "TLR-1 HL High Lumen, Rail-Mounted Tactical Light", Data Sheet, 1 page, dated Jan. 2016, www.streamlight.com.
Streamlight, Inc., "TLR-2 HL Super Bright, 800 Lumen LED Tactical Weapon Light with Red Aiming Laser", Product Specifications, 2 pages, date prior to Oct. 24, 2017, www.streamlight.com.
Streamlight, Inc., "TLR-2 HL/TLR-2 HL G High Lumen, Rail-Mounted Tactical Light with Aiming Laser", Data Sheet, 1 page, dated Jan. 2016, www.streamlight.com.
Streamlight, Inc., "TLR-3 Compact Tactical Weapon-Mounted Light", Product Specifications, 2 pages, date prior to Oct. 24, 2017, www.streamlight.com.
Streamlight, Inc., "TLR-4 Compact Tactical Light with Integrated Red Aiming Laser", Product Specifications, 2 pages, date prior to Oct. 24, 2017, www.streamlight.com.
Streamlight, Inc., "TLR-VIR Infrared Tactical Weapons Light", Product Specifications, 2 pages, date prior to Oct. 24, 2017, www.streamlight.com.

(56) References Cited

OTHER PUBLICATIONS

Streamlight, Inc., "TLR-VIR, Rail-Mounted Tactical Light with Visible White Light and IR Illuminator", Data Sheet, 1 page, dated Jun. 2016, www.streamlight.com.
Streamlight, Inc., "TLR-VIR Pistol Infrared Tactical Weapons Light", Product Specifications, 2 pages, date prior to Oct. 24, 2017, www.streamlight.com.
Streamlight, Inc., "TLR-6 Trigger Guard Mounted Weapon Light with Integrated Red Aiming Laser", Product Specifications, 2 pages, date prior to Oct. 24, 2017, www.streamlight.com.
Streamlight, Inc., "TLR-6 Subcompact Gun-Mounted Tactical Light with Integrated Red Aiming Laser", Data Sheet, 2 pages, dated Mar. 2017, www.streamlight.com.
O-light, "Photo of PL-Mini 2 Valkyrie", date prior to Jul. 23, 2019 filing date, 1 page.
SureFire, "XC1-B Ultra-Compact LED Handgun Light", date prior to Jul. 23, 2019 filing date, 2 pgs, https://www.surefire.com/illumination/weaponlights/handgun/xc1-led-weaponlight.html.
SureFire, "XC2 Ultra-Compact LED Handgun Light and Laser Sight", https://www.surefire.com/illumination/weaponlights/handgun/xc2-compact-led-handgun-light-with-laser.html, date prior to Jul. 23, 2019 filing date, 2 pgs.
Bayco Products Inc., "NightStick TCM-550XL Compact Tactical Weapon-Mounted Light", © 2019, https://www.baycoproducts.com/product/weapon-mounted-lights/item/tcm-550xl, date prior to Jul. 23, 2019 filing date, 5 pages.
Bayco Products Inc., "NightStick Twm-850XL Xtreme Lumens Tactical Weapon-Mounted Light", © 2019, https://www.baycoproducts.com/product/weapon-mounted-lights/item/tcm-550xl, date prior to Jul. 23, 2019 filing date, 5 pages.
Streamlight, Inc., "Mountable Light", Design U.S. Appl. No. 29/711,469, filed Oct. 31, 2019, 37 pages.
Streamlight, Inc., "Mountable Light", Design U.S. Appl. No. 29/745,686, filed Aug. 7, 2020, 22 pages.
Streamlight, Inc., "Mountable Light", Design U.S. Appl. No. 29/745,694, filed Aug. 7, 2020, 22 pages.
Streamlight, Inc., "Mountable Light", Design U.S. Appl. No. 29/745,707, filed Aug. 7, 2020, 22 pages.
Streamlight, Inc., "Tactical Light With Integrated Red Aiming Laser—TLR-2", http://www.streamlight.com/products/detail/index/tlr-2#, Printed Oct. 27, 2020, 2 Pages.
Streamlight, Inc., "TLR-2 Rail Mounted Tactical Light With Laser Sight or Strobing Tactical Light With Laser Sight", Product Fact Sheet, Issued Dec. 13, 2005, Revised Jan. 24, 2019, Rev. 2, Document #252, 1 Page, http://www.streamlight.com/products/detail/index/tlr-2#.
Streamlight, Inc., "TLR-2 Rail Mounted Tactical Light With Red Laser", Info Sheet, Dated Nov. 2017, 4 Pages, http://www.streamlight.com/products/detail/index/tlr-2#.
Streamlight, Inc., "Lightweight and Compact Tactical Weapon-Mounted Light—TLR-3", http://www.streamlight.com/products/detail/index/tlr-3, Printed Oct. 27, 2020, 2 Pages.
Streamlight, Inc., "TLR-3 Compact Rail-Mounted Tactical Light", Data Sheet, © 2018, Dated Dec. 2018, http://www.streamlight.com/products/detail/index/tlr-3, 1 Page.
Streamlight, Inc., "TLR-3 Compact Rail-Mounted Tactical Light", Product Fact Sheet, Issued Jan. 7, 2009, Revised Dec. 8, 2017, Rev. 4, Document #254, 1 Page, http://www.streamlight.com/products/detail/index/tlr-3.
Streamlight, Inc., "TLR-3 Compact Rail-Mounted Tactical Light", Info Sheet, Dated Mar. 2019, http://www.streamlight.com/products/detail/index/tlr-3, 2 Pages.

* cited by examiner

MOUNTABLE LIGHT HAVING INTERCHANGEABLE CLAMPING ELEMENTS

This application claims the benefit and the priority of U.S. Patent Application 63/062,638 filed Aug. 7, 2020, entitled "MOUNTABLE LIGHT HAVING INTERCHANGEABLE CLAMPING ELEMENTS," which is hereby incorporated herein by reference in its entirety.

The present invention relates to a mountable light and, in particular, to a mountable light having interchangeable clamping elements.

There are many different firearms, both long guns and hand guns, available from many manufacturers that may use a firearm rail for mounting accessories, e.g., lights. There are also firearm rails of many different configurations, some of which are standard and some of which are proprietary to particular manufacturers. As a result, owners of plural firearms may need to also have plural different firearm mountable lights that are compatible with the firearm rails of their plural different firearms.

Certain mountable lights are provided with a light module that can be enclosed in different exterior housings so that the assembled light can be used with different firearms. One example of such light is the TLR-6 light available from Streamlight, Inc. of Eagleville, Pa.

Other mountable lights may be provided with interchangeable keys that correspond with certain firearm rails that have sides that are compatible with the clamping jaws of the mountable light. One example of such light with interchangeable keys is the TLR-3 light available from Streamlight, Inc. However, while the key itself may be interchanged, the configuration of the mounting clamp jaws thereof is fixed and therefore only compatible with the sides of a very limited number of types of mounting rails, often only one.

While such lights address making a mountable light compatible with a limited number of different firearm rails, Applicant believes there may be a need for a mountable light that has more flexibility for being used with a wider range of firearms and firearm rails, including both standard rails and proprietary rails.

Accordingly, a mountable light may comprise: a light body having a pair of receptacles; wherein each of the pair of receptacles has a base end that is larger than an opening that is opposite the base end; a light source for providing light; a switch for selectively energizing the light source to produce light; and a set of pairs of clamping members including fixed and movable clamping members compatible with the receptacles. A mounting arrangement on the light body may comprise: a fixed clamping member removably disposed in a first of the pair of receptacles having a base and having a rail interface extending from the base thereof, wherein the base thereof is larger than is the dimension thereof at a location intermediate the base end thereof and the rail interface thereof in substantially the same size and shape as the first of the pair of receptacles; a movable clamping member slidably disposed in a second of the pair of receptacles so as to be movable toward and away from the fixed clamping member and having a base and having a rail interface extending from the base thereof, wherein the base thereof is larger than is the dimension thereof at a location intermediate the base end thereof and the rail interface thereof in substantially the same size and shape as the second of the pair of receptacles so that the movable clamping member is movable in the second of the pair of receptacles toward and away from the fixed clamping member; and a clamping mechanism coupled between the fixed clamping member and the movable clamping member for moving the movable clamping member toward and away from the fixed clamping member. The fixed clamping member and the movable clamping member may be selected to interface with a predetermined firearm rail.

Further, a mountable light may comprise: a light body having forward and rearward ends, and having a pair of receptacles therein located on first and second opposite sides of the light body, wherein each receptacle of the pair of receptacles has a predetermined shape; a light source at the forward end of the light body for providing light; an actuator at the rearward end of the light body for selectively energizing the light source to produce light; and a set of pairs of clamping members including first and second clamping members compatible with the receptacles. A mounting arrangement on an upward side of the light body may comprise: first and second clamping members each having a base of predetermined shape and a rail interface feature. The predetermined shape of the base of each of the first and second clamping members is complementary to the predetermined shape of each receptacle of the pair of receptacles, and wherein the respective predetermined shapes of the bases of the first and second clamping members and of each receptacle of the pair of receptacles restricts the upward and downward movement and the forward and rearward movement of the first and second clamping members in their respective receptacles relative to the light body while permitting movement of the first and second clamping members toward and away from one another. A clamping mechanism coupled between the first and second clamping members for moving the first and second clamping members toward and away from each other. The first and second clamping members may be selected to interface with a predetermined firearm rail.

A method for assembling a mountable light may comprise: obtaining a light body having a pair of opposing receptacles of predetermined retaining shape; obtaining a set of pairs of clamping members including first and second clamping members compatible with the receptacles; selecting first and second clamping members each having a base of the predetermined retaining shape and each having a rail interface feature, wherein the respective rail interface features correspond to features of a firearm rail; inserting the first clamping member with its base in a first of the pair of opposing receptacles; inserting the second clamping member with its base in a second of the pair of opposing receptacles; assembling a clamping mechanism with the first and second clamping members for moving the first and second clamping closer to and farther apart from each other; placing the light body adjacent the firearm rail of a firearm with the firearm rail between the first and second clamping members; and operating the clamping mechanism to clamp the firearm rail between the respective rail interface features of the first and second clamping members.

In summarizing the arrangements described and/or claimed herein, a selection of concepts and/or elements and/or steps that are described in the detailed description herein may be made or simplified. Any summary is not intended to identify key features, elements and/or steps, or essential features, elements and/or steps, relating to the claimed subject matter, and so are not intended to be limiting and should not be construed to be limiting of or defining of the scope and breadth of the claimed subject matter.

BRIEF DESCRIPTION OF THE DRAWING

The detailed description of the preferred embodiment(s) will be more easily and better understood when read in conjunction with the FIGURES of the Drawing which include.

Figure 1A:
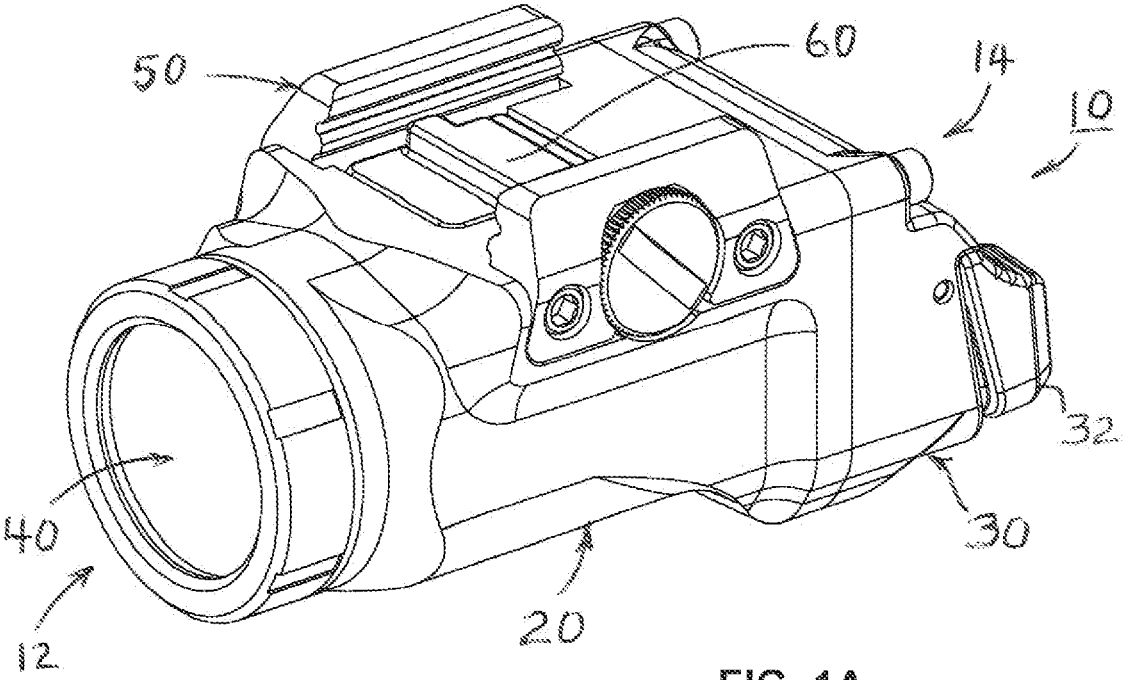
FIGS. 1A, 1B and 1C are perspective views of an example embodiment of a mountable light.

In the Drawing, where an element or feature is shown in more than one drawing figure, the same alphanumeric designation may be used to designate such element or feature in each figure, and where a closely related or modified element is shown in a figure, the same alphanumerical designation may be primed or designated "a" or "b" or the like to designate the modified element or feature. Similar elements or features may be designated by like alphanumeric designations in different figures of the Drawing and with similar nomenclature in the specification. As is common, the various features of the drawing are not to scale, the dimensions of the various features may be arbitrarily expanded or reduced for clarity, and any value stated in any Figure is by way of example only.

DESCRIPTION OF THE PREFERRED EMBODIMENT(S)

Figure 1B:
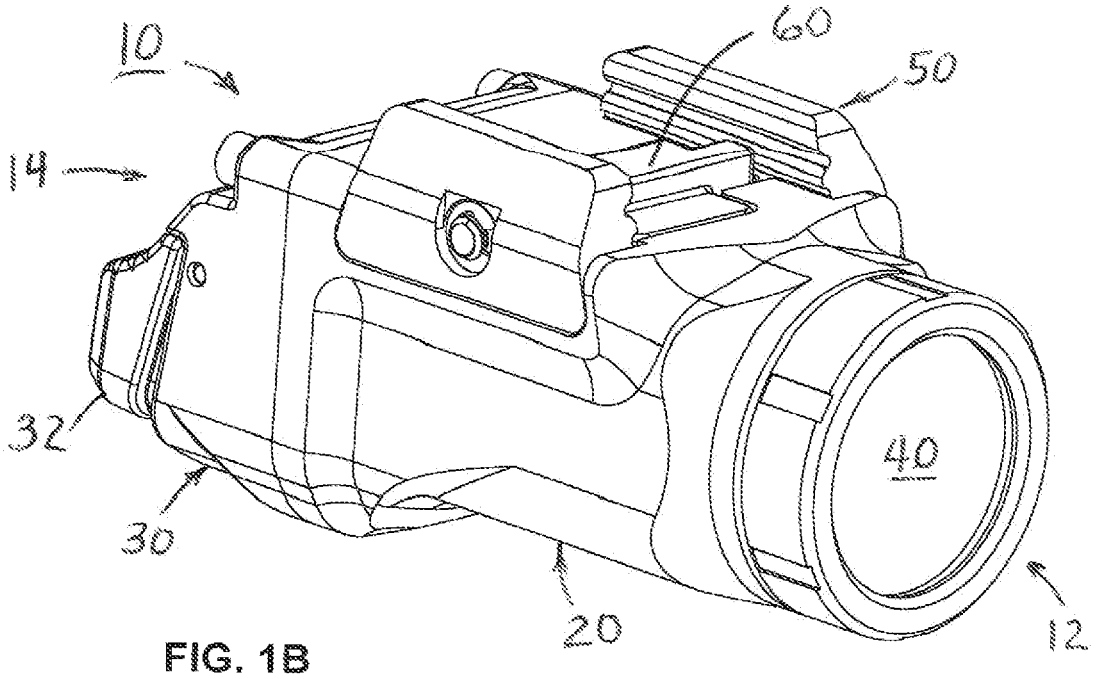
Figure 1C:
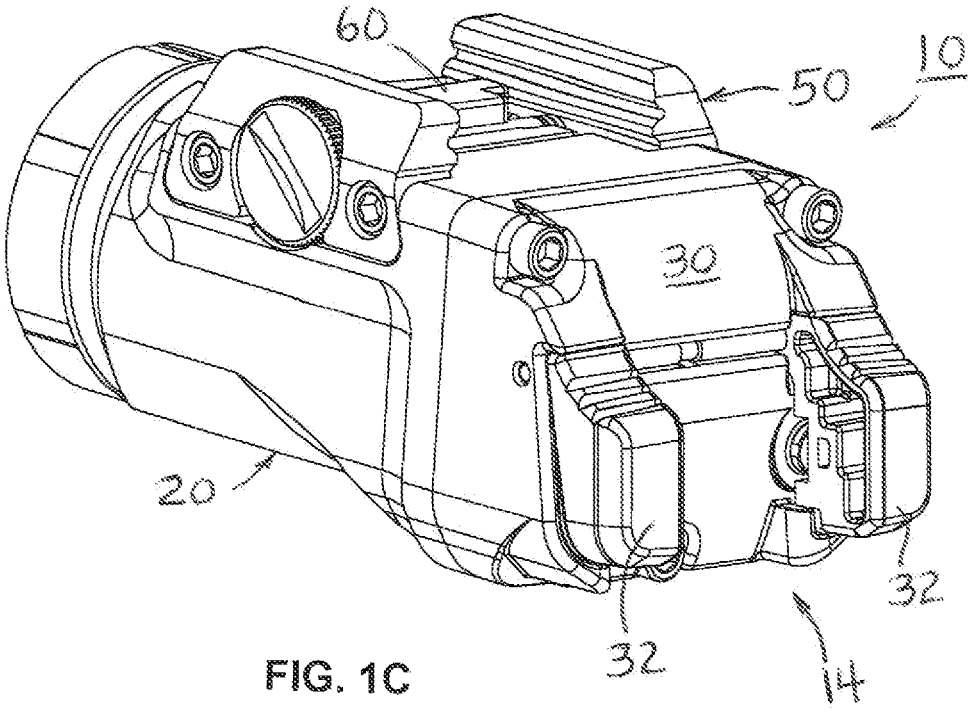
Figure 1D:
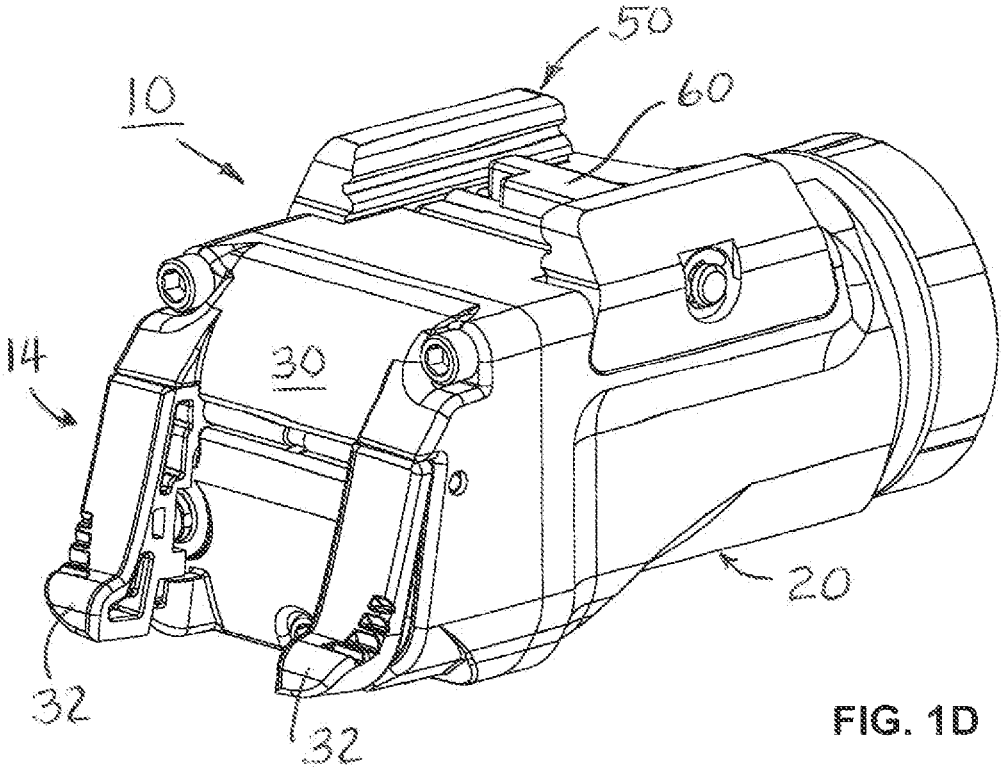
FIG. 1D is a perspective view of the example mountable light of FIGS. 1A through 1C with actuators of a different shape.
Figure 2A:
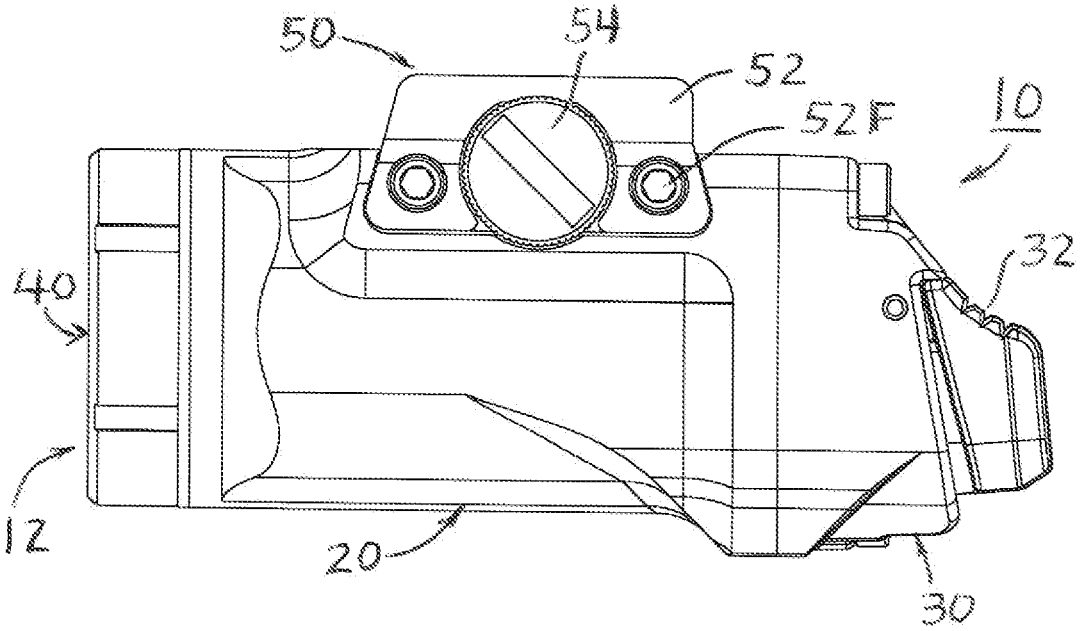
FIGS. 2A, 2B, 2C and 2D are side views of four respective sides of the example mountable light
Figure 2B:
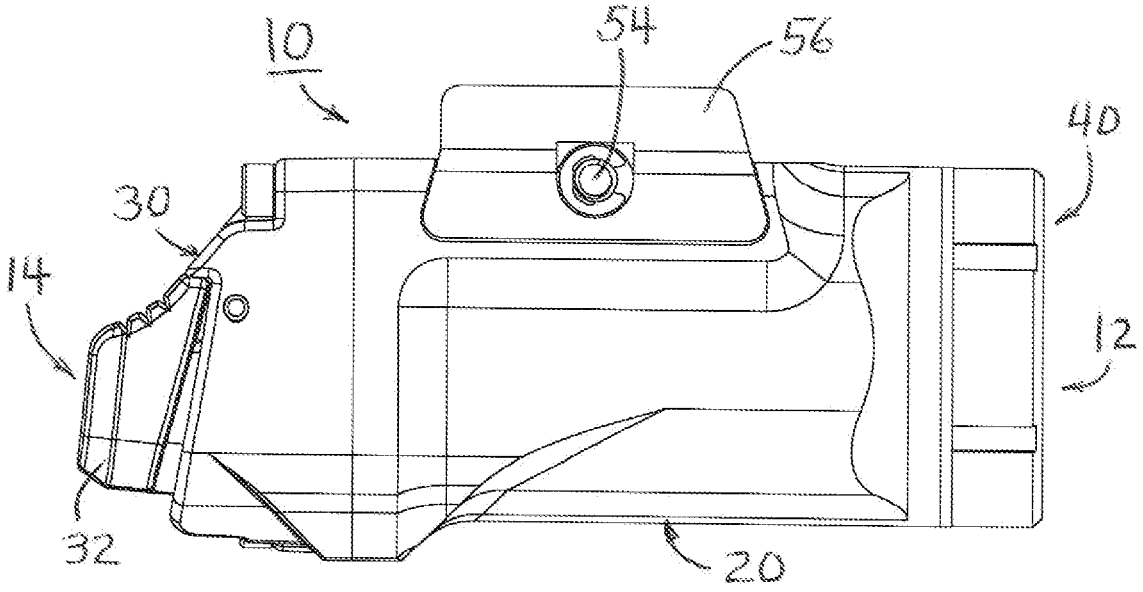
Figure 2C:
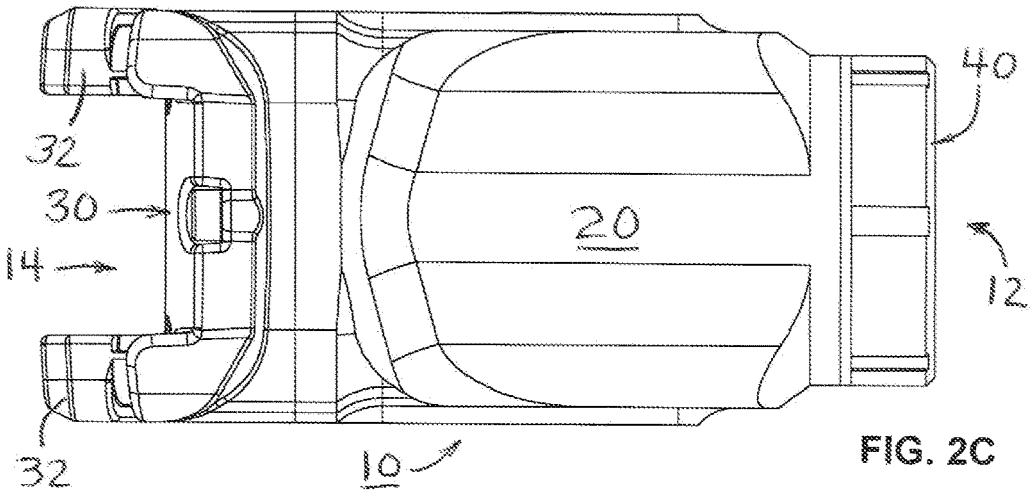
Figure 2D:
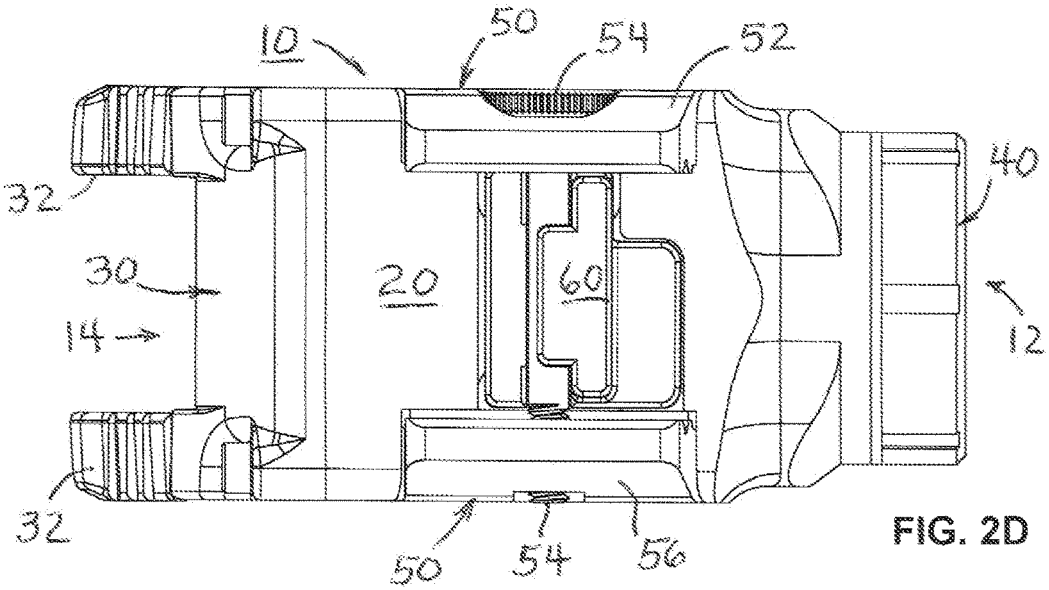
Figure 2E:
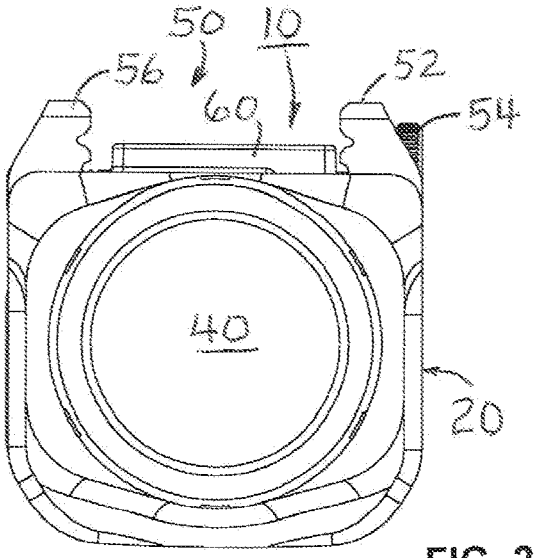
FIGS. 2E and 2F are views of respective ends thereof.
Figure 2F:
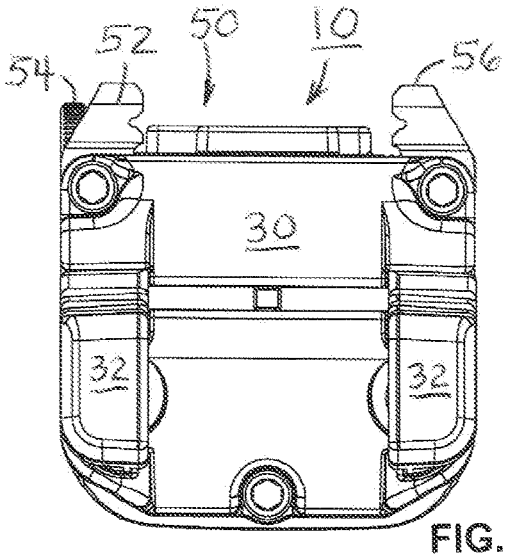

FIGS. 1A, 1B and 1C are perspective views of an example embodiment of a mountable light 10, and FIG. 1D is a perspective view of the example mountable light 10 of FIGS. 1A through 1C with actuators 32 of a different shape; and FIGS. 2A, 2B, 2C and 2D are side views of four respective sides of the example mountable light 10 and FIGS. 2E and 2F are views of respective ends thereof. Example mountable light 10 includes a light body 20 having a tail cap 30 at its rearward end 14 and a light source 40 at its forward end.

A clamping arrangement 50 on one side of the light 10, e.g., an upper or top side thereof when light 10 is mounted to a rail on an under side of the barrel of a firearm, includes a removable fixed clamping member 52, a removable movable clamping member 56 and a clamping mechanism 54 for moving the movable clamping member 56 closer to and farther away from fixed clamping member 52 so as to clamp a firearm rail therebetween and to release the firearm rail. Thus, example mountable light 10 may be clamped onto a firearm rail using clamping arrangement 50 and may be released from the firearm rail using clamping arrangement 50.

Light body 20 has an internal cavity configured for receiving a source of electrical power, e.g., a battery, therein. In a preferred example embodiment, light source 40 is supported in a housing that has a threaded end that threads into a threaded opening at the forward end 12 of the central part of light body 20, thereby to provide a removable cover that can be removed (e.g., un-threaded from) to provide access to the internal cavity for installing the source of electrical power therein and for removing the source of electrical power therefrom. Alternatively, tail cap 30 at the rearward end of light body 20 may be removable for installing and removing the source of electrical power from light body 20 and/or for enabling a tail cap 30 of a different configuration, e.g., a tail cap having a different actuator 32, to be attached thereto.

Adjacent to mounting arrangement 50 of mountable light 10, e.g., between fixed clamping member 52 and movable clamping member 56, is disposed a removable key 60 that cooperates with the clamping members 52, 56 to retain movable light 10 securely on a firearm mounting rail. In particular, each of clamping members 52, 56 has one or more physical engaging features, e.g., ribs and grooves, configured to complement the configuration of a particular firearm mounting rail so that light 10 is secured on the firearm rail in a predetermined position in a direction transverse to the firearm rail, e.g., essentially eliminating side to side movement of light 10 on the firearm rail.

Similarly, key 60 has a keying feature 64 that projects (or extends) away from light body 20 and is configured to complement the configuration of one or more engaging features, e.g., a recess or slot or groove, of the firearm rail, thereby to engage the firearm rail so as to restrict movement of mountable light 10 to a predetermined position in a direction aligned with the barrel of the firearm, e.g., forwardly and rearwardly.

Mountable light 10 is actuated for turning light source 40 ON and OFF by one or more external actuators 32 on tail cap 30 that may be moved, e.g., pressed, to actuate an electrical switch internal to might 10. In the illustrated example light 10, a pair of actuators 32 are spaced apart on the rearward 14 surface of tail cap 30 so as to be disposed adjacent to opposite sides of the trigger guard of a hand-held firearm when light 10 is mounted to a firearm rail on the underside the barrel of the firearm, e.g., one to the left thereof and the other to the right thereof, whereby the light can be conveniently actuated by a finger by both left-handed and right-handed users.

Light 10 of FIG. 1C has an example actuator 32 that has an higher actuator surface, e.g., one that is relatively closer to clamping arrangement 50, whereas light 10 of FIG. 1D has an example actuator 32 that has a relatively lower actuator surface, e.g., one that is farther away from clamping arrangement 50 than is that of FIG. 1C. Having options of different actuators 32, e.g., a HI actuator 32 and a LO actuator 32, provides a greater accommodation of the preferences of users of light 10.

Figure 3:
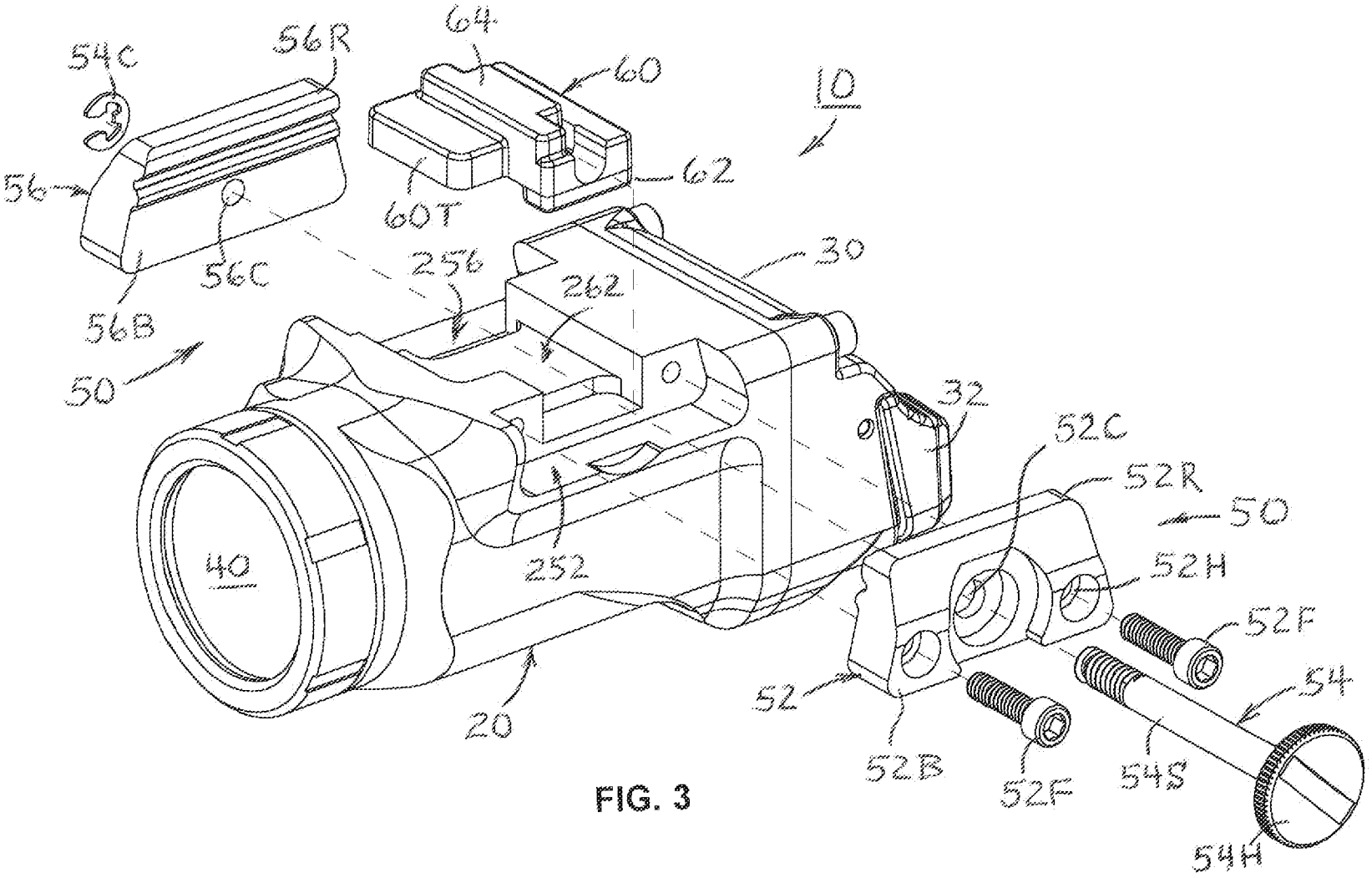
FIG. 3 is an exploded perspective view of the example mountable light of FIGS. 1 through 2F.
Figure 4A:
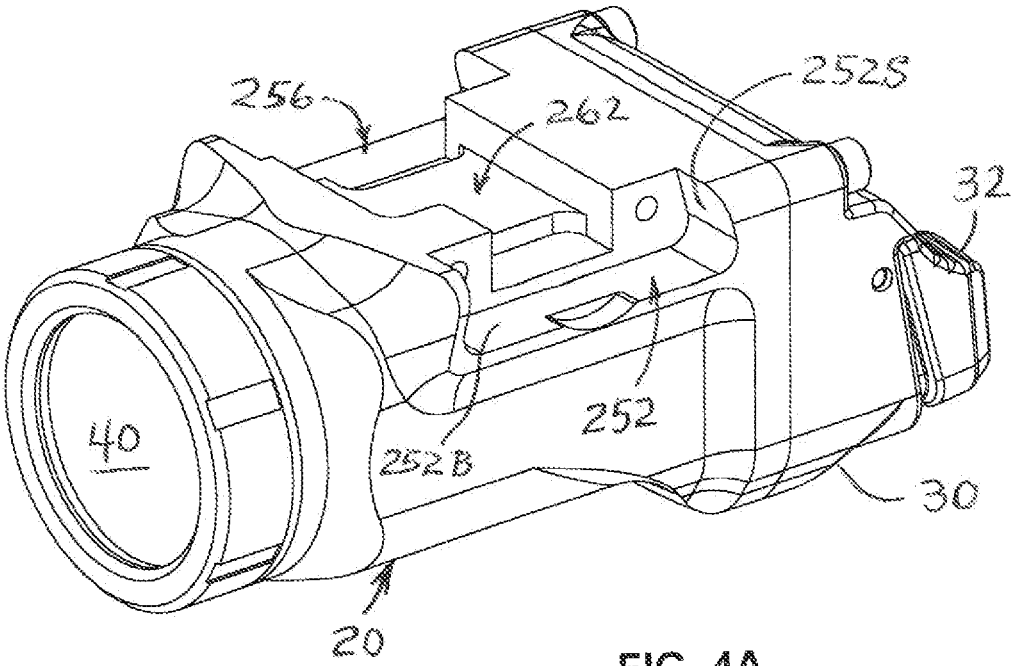
FIG. 4A is a perspective view of an example light body of the example mountable light of FIGS. 1A through 3.
Figure 4B:
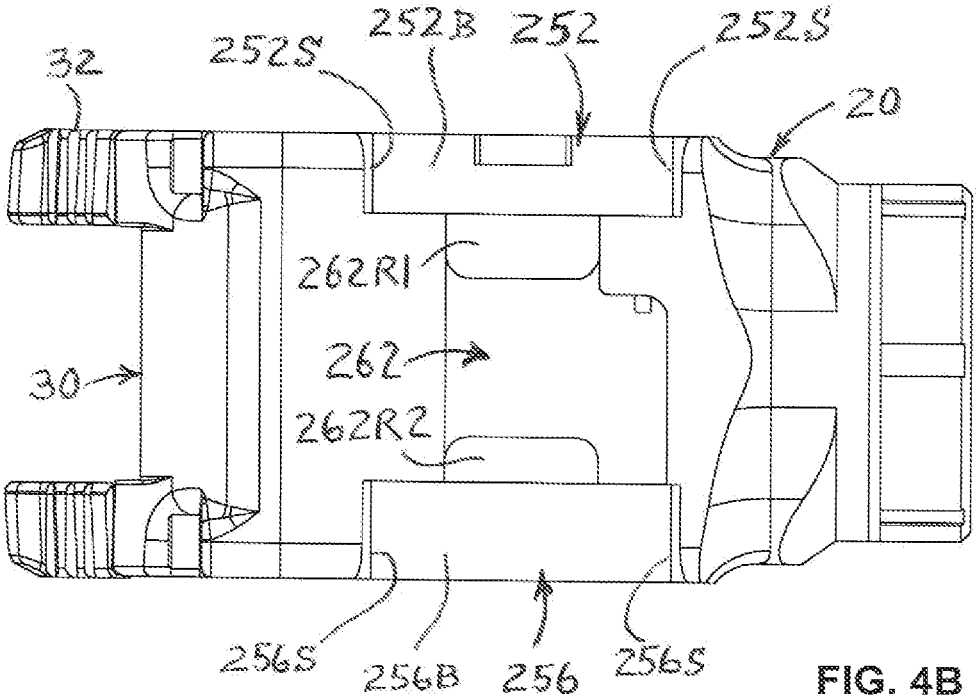
FIG. 4B is a view of one side thereof with the example mounting arrangement removed.

FIG. 3 is an exploded perspective view of the example mountable light 10 of FIGS. 1A through 1D and FIGS. 2A through 2F that illustrates the various elements comprising the mounting arrangement 50 of light 10; and FIG. 4A is a perspective view of an example light body 20 of the example mountable light 10 of FIGS. 1A through 3, and FIG. 4B is a view of one side thereof with the example mounting arrangement 50 removed. Light body 20 has a pair of opposing receptacles 252, 256 configured for receiving elements of clamping arrangement 50 therein disposed in predetermined relative positions so as to be located and movable to clamp a mounting rail of a firearm therebetween.

Each of opposing receptacles 252, 256 is wider at the bottom than it is at the top, herein referred to generally as, e.g., being trapezoidal in shape. Each opposing receptacle 252, 256 is open at a side of light body 20 so that fixed clamping member 52 and movable clamping member 56 may slide therein transversely to and from opposite sides of light 10 and extend above the top of light body 20.

In a typical mounting of example light 10 to a rail of a firearm having the firearm rail beneath its barrel when held in a usual orientation for being used, clamping arrangement 50 is at the top of light 10 which has a longitudinal axis that would be generally parallel to the barrel of the firearm when light 10 is mounted thereto. The forward end of example light 10 has light source 40 emitting light in substantially the same direction as the barrel of the firearm, e.g., the muzzle, points. Actuators 32 are thus at the rear of light 10 and are proximate the trigger guard and/or trigger of the firearm to which light 10 is mounted. As viewed by a user of the firearm, fixed clamping member 52 would be on the left side of the firearm and light 10 and movable clamping member 56 would be on the right side thereof.

Following that orientation terminology, receptacle 252 may be considered to have six sides defining a three dimensional volume, two of which are open sides. Receptacle 252 thus has a bottom wall or surface 252B that is generally horizontal adjacent to which are opposing generally vertical forward and rearward side surfaces 252S that are canted or inclined so as to be closer together at their upper ends than at their ends adjoining bottom wall of receptacle 252, thereby to define a generally trapezoidal receptacle 252. A broader side wall of receptacle 252 is at the side thereof that is closer to the center of example light 10, and has an overall trapezoidal shape defined by its edges adjoining bottom and forward and rearward side walls 252B, 252S thereof, excepting parts thereof that may be missing due to the configuration of key receptacle 262. There are no walls at the upper end of receptacle 252 and at the outward left side thereof, and so receptacle 252 is open thereat so as to permit fixed clamping member 52 to be inserted therein from the left side of example light 10, e.g., transversely to light body 20, with its rail interface feature 52R extending upwardly from the light body 20 of example light 10.

Similarly, receptacle 256 may be considered to have six sides defining a three dimensional volume, two of which are open sides. Receptacle 256 thus has a bottom wall or surface 256B that is generally horizontal adjacent to which are opposing generally vertical forward and rearward side surfaces 256S that are canted or inclined so as to be closer together at their upper ends than at their ends adjoining bottom wall 256B of receptacle 256, thereby to define a generally trapezoidal receptacle 256. A further broader side wall of receptacle 256 is at the side thereof that is closer to the center of example light 10, and has an overall trapezoidal shape defined by its edges adjoining bottom and forward and rearward side walls 256B, 256S thereof, excepting parts thereof that may be missing due to the configuration of key receptacle 262. There are no walls at the upper end of receptacle 256 and at the outward right side thereof, and so receptacle 256 is open thereat so as to permit moveable clamping member 56 to be inserted therein from the right side of example light 10 transversely to light body 20 with its rail interface feature 56R extending upwardly from the light body 20 of example light 10.

Fixed clamping member 52 has a generally trapezoidal base 52B that is of a size and shape to slide into receptacle 252 of light body 20, e.g., with a slip fit, so as to be constrained by the walls 252B, 252S of receptacle 252 move very little in a forward-rearward direction (e.g., along the longitudinal axis of light 10) and in an upward-downward direction (e.g., toward and away from the rail of the firearm). One or more fasteners 52F are disposed through holes 52H of base 52B of fixed clamping member 52 and into holes 252H of light body 20 to retain clamping member 52 in receptacle 252 of light body 20. A rail interface feature 52R extends from base 52B of fixed clamping member 52 so as to extend beyond the top of light body 20 into a position wherein it can be placed adjacent to a first side of a firearm rail.

Movable clamping member 56 has a generally trapezoidal base 56B that is of a size and shape to slide into receptacle 256 of light body 20, e.g., with a slip fit, so as to be constrained by the walls 256B, 256S of receptacle 256 move very little in a forward-rearward direction (e.g., along the longitudinal axis of light 10) and in an upward-downward direction (e.g., toward and away from the rail of the firearm). A rail interface feature 56R extends from base 56B of movable clamping member 56 so as to extend beyond the top of light body 20 into a position wherein it can be placed adjacent to a second side of the firearm rail. Movable clamping member 56 is free to slide inwardly and outwardly (e.g., transversely toward and away from the longitudinal axis of light 10) for enabling fixed clamping member 52 and movable clamping member 56 to clamp the firearm rail therebetween.

While the example fixed clamping member 52 and the example movable clamping member 56 are described as having respective generally trapezoidal bases, and the respective receptacles 252 and 256 therefor are described as defining generally trapezoidal receptacles, other shapes are contemplated. The respective bases 52B, 56B have side walls 52BS, 56BS that are canted or inclined so as to become closer together with increasing distance away from the base wall 52BW, 56BW thereof, thereby defining with base wall 52BW, 56BW a generally trapezoidal shape.

The respective generally trapezoidal shapes of the bases of clamping members 52, 56 restrict upward and downward movement as well as forward and rearward movement of clamping members 52, 56 in their respective receptacles 252, 256, while permitting their movement toward and away from one another. e.g., transversely to light body 20 and light 10. Other shapes therefor, e.g., other predetermined or predefined shapes, that similarly restrict and permit movement of clamping members 52, 56 relative to light body 20 and each other may also be employed.

The receptacles and the bases of the clamping members are referred to as having the same size and shape and/or having substantially the same shape and size as each of the pair of receptacles, which includes sufficient difference in size and shape for the clamping members to move towards and away from each other when in the respective receptacles while being sufficiently restrained from moving forward and rearward and from moving upward and downward to a degree that would result in the position of the light on the firearm rail changing excessively, e.g., that would direct the light therefrom in other than the desired direction.

A clamping mechanism 54 is provided for moving fixed clamping member 52 and movable clamping member 56 closer together so as to grasp or clamp the sides of the firearm rail therebetween. While clamping mechanism 54 may take different forms, a preferred example thereof includes a clamping screw 54 having a head 54H that bears against the outer surface of fixed clamping member 52, e.g., in a recess that is part of central opening 52C thereof, and having a shaft 54S that extends through central opening 52H transversely to the longitudinal axis of light 10 to engage movable clamping member 56, e.g., at a central opening thereof. In the preferred example, shaft 54S is threaded at its end distal from head 54H to engage threaded central opening 56C of movable clamping member 56, and is disposed in the slot 63 of interchangeable key 60.

Thus rotating clamping screw 54 in one direction, e.g., clockwise, rotates shaft 54S into central opening 56C and moves movable clamp member 56 which is disposed in receptacle 256 to slide in receptacle 256 towards fixed clamping member 52 for clamping a rail therebetween. Rotating clamping screw 54 in the opposite direction, e.g., counter-clockwise, rotates shaft 54S out of central opening 56C and moves movable clamp member 56 which is disposed in receptacle 256 to slide in receptacle 256 away from fixed clamping member 52 for releasing a rail clamped therebetween.

Optionally, clamping mechanism 54 may include a member 54C to prevent clamping screw 54 from being rotated to the point where it disengages from clamping member 56. An example thereof may include a member 54C such as a pin or clip 54C, e.g., an E-clip 54C, and preferably a removable element 54C so that the elements 52, 54, 56 of clamping arrangement 50 may be removed from light body 20.

Accordingly, the elements 52, 54, 56 of clamping arrangement 50 may be removed from light 10 and a different clamping arrangement 50, e.g., one having fixed and movable clamping members 52, 54 that have respective rail interface features configured for grasping a firearm rail of a different configuration, may be installed on light 10 to grasp and release the different firearm rail. This is an advantage to users of the light 10 who thereby need only one light 10 that can be reconfigured with different sets of mounting arrangement 50 for interfacing with firearm rails of different configurations on other firearms.

Further a key 60 may be associated with clamping arrangement 50 for engaging the firearm rail to restrict forward and rearward movement of light 10 on the firearm rail. Preferably, key 60 is an interchangeable key 60 which can be installed to and removed from light body 20 of light 10. Preferably a set of interchangeable keys 60 are available so that light 10 may be utilized with firearm rails on different configurations.

Each interchangeable key 60 has a key base 62 of the same configuration for engaging a complementary key structure 262 of light body 20 in the space between clamping members 52 and 56. In a preferred example, key structure 262 is a key receptacle 262 having a raised central portion flanked by a pair of recesses, and key base 62 has a central recess flanked by a pair of raised projections that are complementary to structure 262 so as to fit therewith in a predetermined position relative to light body 20 and clamping members 52, 56. The arrangement of the key base 62 is preferably asymmetric so that the base 62 of selected key 60 will fit into receptacle 262 only in the proper orientation.

Preferably, key base 62 and structure 262 engage to limit both side-to-side and forward-rearward movement of key 60 relative to light body 20. Other complementary configurations of structure 262 and key base 62 may be employed, e.g., a simple projection on one and a complementary recess in the other. Optionally, key 60 may have a tab 60T and the structure of receptacle 262 may have a recess complementary thereto; and tab 60T may provide, e.g., a surface on which an identifying marking may be placed.

Each interchangeable key 60 has a keying feature 64 in or extending from base 60B for engaging a complementary feature of a firearm rail. Typically, keying feature 64 is a projection of a predetermined shape and size that engages a complementary recess in the firearm rail with which it is intended to be used. Example keying features 64 may be square, rectangular, oblong, cylindrical and the like in shape and may be located at different locations atop key base 62.

Key 60 may be retained adjacent to structure 262 by any suitable means, e.g., including a fastener. In a preferred example, an exposed surface of the base 62 of key 60 has a transverse slot 63 therein through which the shaft 54S of clamping mechanism 54 is disposed when mounting arrangement is assembled on light body 20. A transverse hole 63 through the base 64 of key 60 could also be utilized with shaft 54S passing therethrough.

Key 60 may be one of a set of interchangeable keys 60 of which examples are described herein. Each key 60 of the set of keys 60 has the same base 62 configuration which corresponds with the receptacle 262 of light body 20 into which key 60 is placed and has a keying feature 64 of a different shape and size that may be located at a different location on key base 62, thereby to be compatible to engage with a complementary feature of the firearm rail with which it is intended to be used.

Figure 5A:
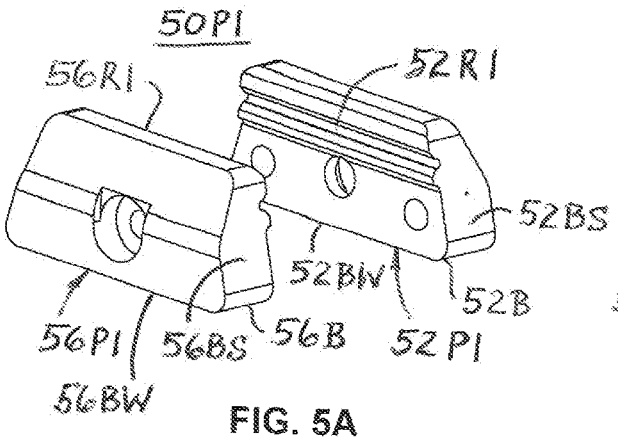
FIGS. 5A and 5B are respective perspective views of example embodiments of different pairs of interchangeable clamping members for the example mountable light that together are a set thereof.
Figure 5B:
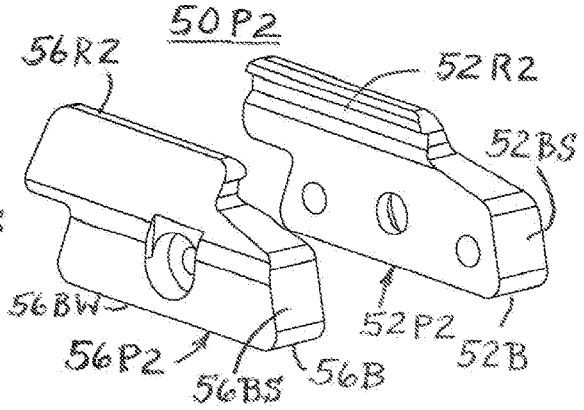

FIGS. 5A and 5B are respective perspective views of example embodiments of different pairs of interchangeable clamping members 50P1, 50P2 for the example mountable light 10 that together comprise a set of pairs of interchangeable clamping members. The pair of clamping members 50P1 of FIG. 5A and the pair of clamping members 50P2 of FIG. 5B each include a respective fixed clamping member 52P1, 52P2 and a respective moveable clamping member 56P1, 56P2 each having respective bases 52B, 56B of similar size and shape as previously described and each having different respective rail interface members 52R1, 56R1 and 52R2, 56R2.

Each base 52B, 56B of the different pairs of interchangeable clamping members 50P1, 50P2 for a particular type or model of mountable light 10 is preferably of a size and shape for being received in the respective receptacles 252, 256 of the body 20 of that light 10. Each clamping member 52P1, 52P2 has corresponding openings and/or holes in locations on the respective bases 52B thereof for receiving fastener(s) 52F as may be provided for retaining fixed clamping member 52P1, 52P2 in the receptacles 252 of light body 20. Each clamping member 52P1, 52P2 has corresponding openings and/or holes in locations on the respective bases 52B thereof for receiving clamping mechanism 54 therein for moving movable clamping member 56P1, 56P2 towards fixed clamping member 52P1, 52P2, respectively for clamping light 10 to a firearm rail.

Each base 52B, 56B for the different pairs of interchangeable clamping members 50P1, 50P2 is wider at its bottom end than it is at a location, e.g., sometimes referred to for convenience as its waist, on clamping member 52P1, 56P1 that is intermediate the base 52B, 56B thereof and the rail interface feature 52R1, 52R2, 56R1, 56R2 thereof. Thus the bottom surface of each base 52B, 56B is longer than is the dimension thereof at the waist thereof, and both end surfaces of each base 52B, 56B is inclined inward so that each base 52B, 56B is generally trapezoidal in shape. Each base 52B, 56B is defined as having a trapezoidal shape wherever the waist dimension thereof is sufficiently shorter than the dimension of the bottom surface thereof so that fixed clamping members 52P1, 52P2 and moveable clamping members 56P1, 56P2 can be removed from their respective receptacles 252, 256 only by being moved transversely to light body 20, i.e. away from each other, in respective outward directions.

The example pair of clamping members 50P1 of FIG. 5A includes a fixed clamping member 52P1 and a moveable clamping member 56P1 having respective rail interface members 52R1, 56R1 that correspond to a configuration of a specific firearm rail, e.g., to the ridges and/or grooves of the opposing side edges thereof. The respective rail interface members 52R1, 56R1 of fixed clamping member 52P1 and of moveable clamping member 56P1 are of approximately the same length as is the waist thereof and are located longitudinally in substantial alignment with the respective bases 52B, 56B thereof.

The example pair of clamping members 50P2 of FIG. 5B includes a fixed clamping member 52P2 and a moveable clamping member 56P2 having respective rail interface members 52R2, 56R2 that correspond to a configuration of a specific firearm rail, e.g., to the ridges and/or grooves of the opposing side edges thereof, that is different than the specific firearm rail that the pair of clamping members 50P1 correspond to. The respective rail interface members 52R2, 56R2 of fixed clamping member 52P2 and of moveable clamping member 56P2 are longitudinally offset from the respective bases 52B, 56B thereof. Such offset arrangement allows a light 10 having the example pair of clamping members 50P2 mounted thereon to be clamped to a relatively shorter firearm rail, e.g., one that does not extend from the trigger area toward the muzzle of the firearm as far as does the firearm rail that the example pair of clamping members 50P1 clamps to.

A particular pair of clamping members 52, 56 may have rail interface features 52R, 56R that are compatible with plural different firearm rails wherein the arrangement of ridges and/or grooves of the rail interface feature 52R, 56R of those clamping members 52, 56 are complementary to the ridges and/or grooves of different firearm rails. For example, the firearm rails of a particular manufacturer on different firearms may have the same or sufficiently similar ridges and/or grooves along the side edges thereof while those of a different manufacturer or of a standard rail or of a different firearm may have a different arrangement of ridges and/or grooves.

It is expected that at least one pair of clamping members will be provided with each mountable light 10, however, two or more pairs of clamping members can be provided with a mountable light 10, e.g., as a set of pairs of clamping members for the light 10, or may be provided separately from a light 10, e.g., as a set of pairs of clamping members for clamping light 10 to different firearm rails.

Figure 6A:
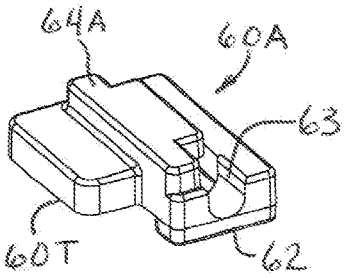
FIGS. 6A and 6B are respective perspective views of examples of different interchangeable keys for the example mountable light.
Figure 6B:
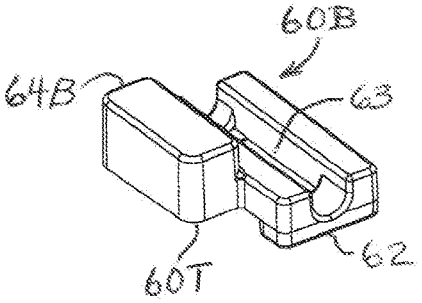
Figure 6C:
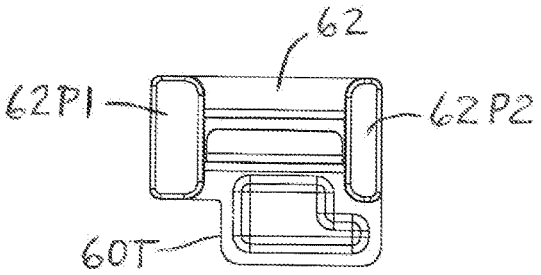
FIG. 6C is a plan view of the base of the interchangeable keys.

FIGS. 6A and 6B are perspective views of different interchangeable keys 60 for the example mountable light 10, and FIG. 6C is a plan view showing the underside of the base 62 of the interchangeable keys 60. Two or more different interchangeable keys 60A, 60B comprise a set of interchangeable keys 60, 60A, 60B. Each key 60, 60A, 60B has a key base 62 and has a keying feature 64, 64A, 64B extending from key base 62 so as to engage a corresponding feature of a firearm rail with which it is compatible. Optionally, but preferably, each key 60, 60A, 60B may also have a key tab 60T that provides a surface on which identifying information and/or indicia may be provided, e.g., to identify the firearm or firearm rail with which that key is compatible.

Each interchangeable key 60, 60A, 60B has a key base 62 of the same size and shape for being placed in the receptacles 262 of like size and shape of mountable lights 10. Each different interchangeable key 60, 60A, 60B corresponds to a different particular firearm rail. Thus a user may select a particular interchangeable key 60, 60A, 60B corresponding to a firearm with which the user desires to utilize a mountable light 10, whereby any light 10 may be utilized with any firearm rail corresponding to one of the interchangeable keys 60, 60A, 60B.

Each key base 62 is of the same configuration, e.g., of the same size and shape. In the illustrated examples thereof, key base 62 has a pair of spaced apart projections 62P1, 62P2 that are of a size and shape to fit into corresponding recesses 262R1, 262R2 of receptacle 262 of light body 20 of mountable light 10, whereby key 60 is in a predetermined location and position relative to light body 20 of light 10 and to clamping members 52, 56 thereof.

Example key 60A has a keying feature 64A extending upward from base 62 thereof proximate slot 63 or opening 63 therein for engaging a complementary feature of a firearm rail. Keying feature 64A of example key 60A is "T-shaped" so as to interface and engage a firearm rail feature that may be, e.g., a transverse slot and an adjacent recess.

Example key 60B has a keying feature 64B extending upward from base 62 thereof proximate slot 63 or opening 63 therein for engaging a complementary feature of a firearm rail. Keying feature 64B of example key 60B is substantially rectangular so as to interface and engage a firearm rail feature that may be, e.g., a wide transverse slot or recess. Example key 60B also illustrates that the structure of tab 60T may be utilized in addition to base 62 for supporting all or part of keying feature 64B; further, in this example key identifying indicia may be provided on keying feature 64B of key 60B.

It is expected that at least one interchangeable key 60 will be provided with each mountable light 10, however, two or more interchangeable keys 60, 60A, 60B can be provided with a mountable light 10, e.g., as a set of interchangeable keys 60, 60A, 60B for the light 10, or may be provided separately from a light 10, e.g., as a set of interchangeable keys 60, 60A, 60B for clamping light 10 to different firearm rails.

Figure 7:
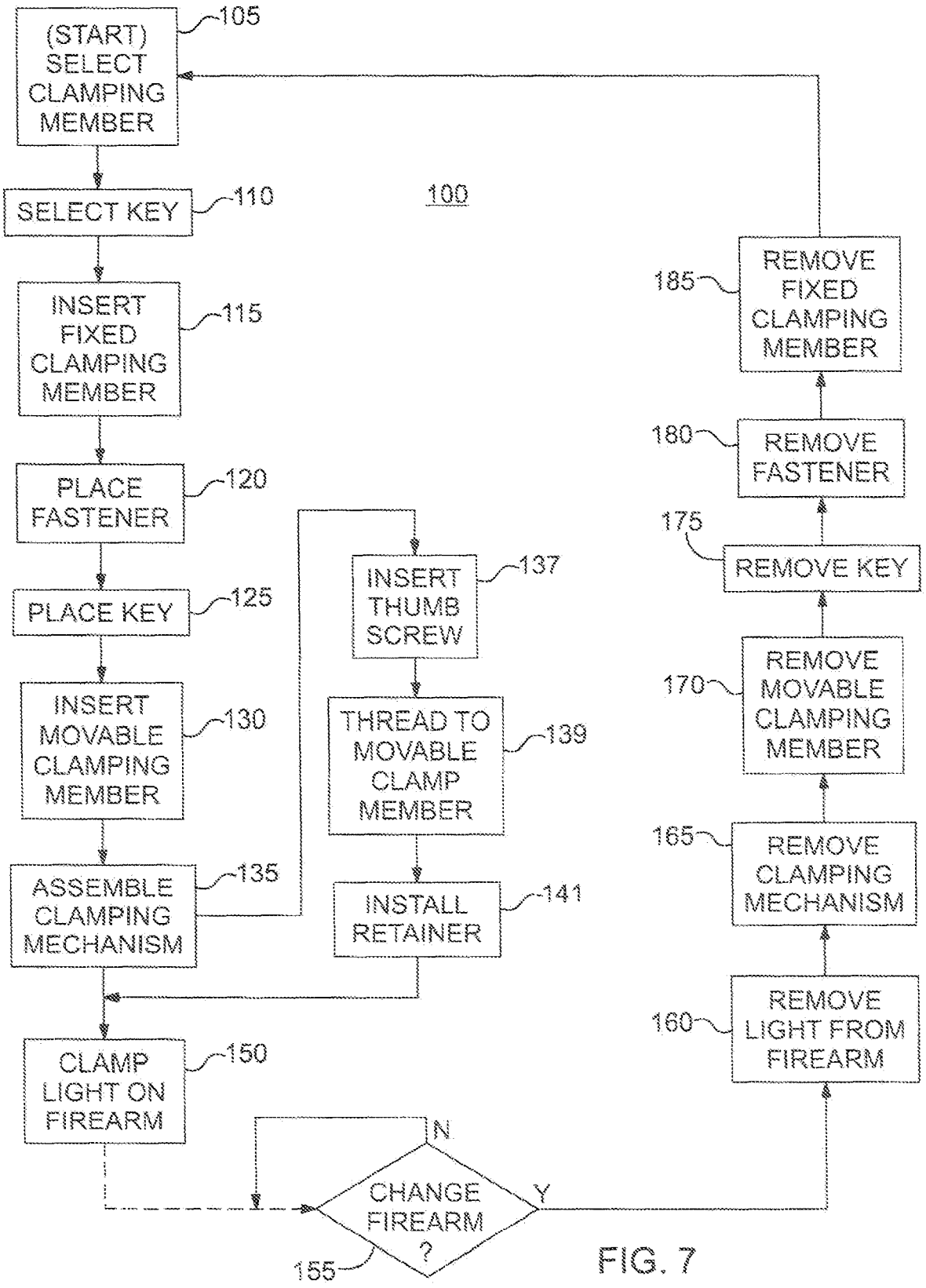
FIG. 7 is a schematic flow diagram of an example assembly method relating to assembly and disassembly of the example interchangeable mounting arrangement of the example light.

FIG. 7 is a schematic flow diagram of an example assembly method 100 relating to assembly and disassembly of the interchangeable mounting arrangement 50, 60 of the example light 10. Assembly and disassembly of mounting arrangement 50 and key 60 of light 10 may be made using a method 100 as follows. While various operations, steps and/or elements of the process or method or operation may be described in an order or sequence, the operations and/or steps do not need to be performed in that order or sequence, or in any particular order or sequence, unless expressly stated to require a particular order or sequence.

Method 100 starts with selecting 105 a set of clamping members 52, 56 corresponding to the firearm rail to which the light 10 is to be mounted along with selecting 110 a key 60 also corresponding to that firearm rail. The fixed clamping member 52 from the selected set is inserted 115 into receptacle 252, e.g., from the side of light 10, with the wider part of base 52B being in the wider part of receptacle 252 and with rail interface feature 52R extending above the top of light 10. One or more fasteners 52F are disposed 120 through the one or more holes 52H of clamping member base 52B to engage holes 252 of light body 20 thereby to retain fixed clamping member 52 in the predetermined position in receptacle 252 of light body 20.

The selected key 60 is placed 125 in receptacle 262 with the base 62 thereof in proper orientation to be received therein and be fully seated. Preferably the key base 62 and receptacle 262 are of substantially the same size and shape so that key 60 fits therein in a predetermined position with little play. Key 60 in the example arrangement is not retained in receptacle 262 until clamping mechanism 54 is assembled 135 to light 10.

Movable clamping member 56 of the selected set thereof is inserted 130 into receptacle 256, e.g., from the side of light 10, with the wider part of base 56B thereof being in the wider part of receptacle 256 and with rail interface feature 56R extending above the top of light 10. The base 56B of movable clamping member 56 is of substantially the same size and shape as receptacle 256 so that it is slidable therein toward and away from fixed clamping member 52. The base 56B of clamping member 56 preferably is, e.g., a relatively tight slip fit into receptacle 256 so that it may be moved sideways therein towards and away from fixed clamp member 52 without moving substantially in any other direction, e.g., rotationally or horizontally side-to-side or vertically up or down.

Thus the respective rail interface features 52R, 56R of fixed and movable clamping members 52, 56 are disposed 115-130 opposite to each other in predetermined positions corresponding to the sides of the firearm rail to which they are intended to clamp.

Clamping mechanism 54 is then assembled 135 to light 10. clamping mechanism 54, e.g., clamping screw 54, is inserted 137 through central opening 52C of fixed clamping member 52, through the slot in or a similar hole through key 60, and into hole 56C of movable clamping member 56 and rotated to engage 139 movable clamping member 56 for moving it towards and away from fixed clamping member 52 for engaging and releasing the firearm rail to which it is intended to clamp. Optionally, but preferably, a retainer 54C, e.g., an E-ring clip 54C, of clamping mechanism 54 is installed 141 to retain clamping mechanism 54 in place in mounting arrangement 50, whereby mounting arrangement 50 is retained 135 on light 10 unless a user intends to remove it and begins by removing the retainer 54C.

Light 10 with clamping arrangement 50 thereon is ready to be clamped 150 to a firearm of the type corresponding the selected 105, 110 clamping members 52, 56 and key 60, e.g., by being placed onto the firearm rail thereof and tightening clamping mechanism 50. If the user does not decide 155N to change the firearm 155 with which light 10 is used, method 100 remains at this step. If and when the user decides to change the firearm 155Y with which light 10 is used, method 100 proceeds for removing 160-185 clamping arrangement 50 from light 10.

Removal of clamping arrangement 50 from light 10 is by performing the steps 160-185 of assembly method 100 substantially in reverse order. It begins with removing 160 the light 10 from the firearm and disassembling 165-185 clamping arrangement 50 from light 10. Disassembly 165-185 includes removing 165 clamping mechanism 50 from light 10, e.g., removing the retainer 56C, un-threading and removing thumb screw 54 from light 10. Movable clamping member 56 is removed 170 as is 175 removable key 60. Fastener 52F is removed 180 releasing fixed clamping member 52 which can then be removed 185.

Following removal of clamping arrangement 50 from light body 20 new clamping members 52, 56 corresponding to a different firearm are selected 105, 110 to commence the assembly of the clamping arrangement 50 corresponding to the new firearm.

A mountable light may comprise: a light body having a cavity for receiving a source of electrical power, having a pair of receptacles therein located on opposite sides of the light body for receiving respective clamping members therein; wherein each of the pair of receptacles has a configuration including a base end that is larger than an opening thereof that is opposite the base end; a light source supported by the light body for providing light; a switch supported by the light body for selectively energizing the light source to produce light; and a set of clamping members may include at least two pairs of clamping members wherein each pair of clamping members includes a fixed clamping member and a movable clamping member each having a base of the same configuration as the pair of receptacles of the light body and each having a rail interface feature compatible with the same firearm rail, and wherein different pairs of clamping members have rail interface features compatible with different firearm rails; a mounting arrangement on the light body may include: a fixed clamping member of a first pair of clamping members selected from the set of at least two pairs of clamping members, the fixed clamping member having its base removably disposed in a first of the pair of receptacles, the fixed clamping member having a rail interface extending from the base thereof, wherein the base thereof is larger than is the dimension thereof at a location intermediate the base end thereof and the rail interface thereof in substantially the same size and shape as a first of the pair of receptacles; a fastener retaining the fixed clamping member in the first of the pair of receptacles; a movable clamping member of the first pair of clamping members selected from the set of at least two pairs of clamping members, the movable clamping member being slidably disposed in a second of the pair of receptacles so as to be movable toward and away from the fixed clamping member, the movable clamping member having a rail interface extending from the base thereof, wherein the base thereof is larger than is the dimension thereof at a location intermediate the base end thereof and the rail interface thereof in substantially the same size and shape as the second of the pair of receptacles so that the movable clamping member is movable in the second of the pair of receptacles toward and away from the fixed clamping member; and a clamping mechanism coupled between the fixed clamping member and the movable clamping member for moving the movable clamping member toward and away from the fixed clamping member, wherein the fixed clamping member and the movable clamping member of the mounting arrangement on the light body are selected from the set of pairs of clamping members to interface with a particular firearm rail. Each of the pair of receptacles may have a trapezoidal shape and the respective bases of the fixed clamping member and the movable clamping member have substantially the same trapezoidal shape and size as each of the pair of receptacles. The clamping mechanism may comprise: a clamping screw having a head and a threaded shaft, wherein the threaded shaft of the clamping screw is disposed through a hole in one of the fixed clamping member and the movable clamping member and engages a threaded hole in the other of the fixed clamping member and the movable clamping member. The mountable light may further comprise: a removable key disposed in a key receptacle between the pair of receptacles, whereby the removable key is disposed between the fixed clamping member and the movable clamping member; and wherein the removable key is configured to interface with the firearm rail with which the fixed clamping member and the movable clamping member are compatible. The mountable light may further comprise: a set of interchangeable keys wherein each interchangeable key has a base of the same configuration as the receptacle for receiving a removable key and has a keying feature compatible with a particular firearm rail, and wherein different ones of the interchangeable keys of the set thereof have respective keying features compatible with different firearm rails, wherein the removable key is selected from the set of interchangeable keys.

A mountable light may comprise: a light body having forward and rearward ends, having a cavity for receiving a source of electrical power, and having a pair of receptacles therein located on first and second opposite sides of the light body, wherein each receptacle of the pair of receptacles has a predetermined shape; a light source at the forward end of the light body for providing light; an actuator at the rearward end of the light body for selectively energizing the light source to produce light; and a set of pairs of clamping members including at least two pairs of clamping members, wherein each pair of clamping members includes a first clamping member and a second clamping member each having a base of the predetermined shape and each having a rail interface feature compatible with the same firearm rail, and wherein different pairs of clamping members have rail interface features compatible with different firearm rails, a mounting arrangement on an upward side of the light body may comprise: a pair of clamping members including a first clamping member and a second clamping member selected from the set of pairs of clamping members each having a base of the predetermined shape and a rail interface feature; wherein the predetermined shape of the base of each of the first and second clamping members is complementary to the predetermined shape of each receptacle of the pair of receptacles, and wherein the respective predetermined shapes of the bases of the first and second clamping members and of each receptacle of the pair of receptacles restricts the upward and downward movement and the forward and rearward movement of the first and second clamping members in their respective receptacles relative to the light body while permitting movement of the first and second clamping members toward and away from one another; and a clamping mechanism coupled between the first and second clamping members for moving the first and second clamping members toward and away from each other, wherein the first and second clamping members of the mounting arrangement on the light body are selected from the set of pairs of clamping members to interface with a particular firearm rail. The base of each of the first and second clamping members has a dimension at a base end thereof that is larger than is the dimension thereof at a location intermediate the base end thereof and the rail interface of the first and second clamping members in substantially the same shape and size as each of the pair of receptacles. Each of the pair of receptacles has a trapezoidal shape and the respective bases of the first and second clamping members have substantially the same trapezoidal shape and size as each of the pair of receptacles. The clamping mechanism may comprise: a clamping screw having a head and a threaded shaft, wherein the threaded shaft of the clamping screw is disposed through a hole in one of the first and second clamping members and engages a threaded hole in the other of the first and second clamping members. The first clamping member may be fastened to the light body to be retained in a first of the pair of receptacles thereof, and wherein the second clamping member is movable toward and away from the first clamping member. The mountable light may further comprise: a removable key removably disposed in a key receptacle of the light body between the first and second clamping members; wherein the removable key is selected to interface with the same particular firearm rail as are the first clamping member and the second clamping member. The mountable light may further comprise: a set of interchangeable keys wherein each interchangeable key has a base of the same configuration and has a keying feature compatible with a particular firearm rail, and wherein different ones of the interchangeable keys of the set thereof have respective keying features compatible with different firearm rails, wherein the removable key is selected from the set of interchangeable keys.

A mountable light may comprise: a light body having forward and rearward ends and a longitudinal axis therebetween, having a cavity for receiving a source of electrical power, and having a pair of receptacles therein located on first and second opposite sides of the light body, wherein each receptacle of the pair of receptacles has a predetermined shape; a light source on the light body for providing light; an actuator on the light body for selectively energizing the light source to produce light; a set of pairs of clamping members including at least two pairs of clamping members, wherein each pair of clamping members includes a first clamping member and a second clamping member each having a base of the predetermined shape and each having a rail interface feature compatible with the same firearm rail, and wherein different pairs of clamping members have rail interface features compatible with different firearm rails, a mounting arrangement on a side of the light body may comprise: a pair of clamping members including a first clamping member and a second clamping member selected from the set of pairs of clamping members each having a base of the predetermined shape and a rail interface feature; wherein the predetermined shape of the base of each of the first and second clamping members is complementary to the predetermined shape of each receptacle of the pair of receptacles, and wherein the respective predetermined shapes of the bases of the first and second clamping members and of each receptacle of the pair of receptacles restricts movement of the first and second clamping members in their respective receptacles in directions parallel to and transverse to the longitudinal axis of the light body except in a direction wherein the first and second clamping members move toward and away from one another; and a clamping mechanism coupled between the first and second clamping members for moving the first and second clamping members toward and away from each other, wherein the first and second clamping members of the mounting arrangement on the light body are selected from the set of pairs of clamping members to interface with a particular firearm rail. The base of each of the first and second clamping members has a dimension at a base end thereof that is larger than is the dimension thereof at a location intermediate the base end thereof and the rail interface of the first and second clamping members in substantially the same shape and size as each of the pair of receptacles. Each of the pair of receptacles has a trapezoidal shape and the respective bases of the first and second clamping members have substantially the same trapezoidal shape and size as each of the pair of receptacles.

A method for assembling a mountable light may comprise: obtaining a light body having a pair of opposing receptacles of predetermined retaining shape; obtaining a set of pairs of clamping members including at least two pairs of clamping members, wherein each pair of clamping members includes a first clamping member and a second clamping member each having a base of the predetermined retaining shape and each having a rail interface feature compatible with the same firearm rail, and wherein different pairs of clamping members have rail interface features compatible with different firearm rails; selecting from the set of pairs of clamping members a pair of clamping members including first and second clamping members each having a base of the predetermined retaining shape and each having a rail interface feature, wherein the respective rail interface features correspond to features of a particular firearm rail; inserting the first clamping member with its base in a first of the pair of opposing receptacles; inserting the second clamping member with its base in a second of the pair of opposing receptacles; assembling a clamping mechanism with the first and second clamping members for moving the first and second clamping closer to and farther apart from each other; placing the light body adjacent a firearm rail with the firearm rail between the first and second clamping members; and operating the clamping mechanism to clamp the firearm rail between the respective rail interface features of the first and second clamping members. The method may further comprise: fastening the base of the first clamping member in the first of the pair of opposing receptacles of the light body. The light body may have a key receptacle between the pair of opposing receptacles, and the method may further comprise: selecting an interchangeable key having a key base configured to be placed into the key receptacle and a keying feature compatible with the firearm rail; and prior to the assembling a clamping mechanism, placing the selected interchangeable key into the key receptacle. The light body may have a key receptacle between the pair of opposing receptacles, and the method may further comprise: selecting an interchangeable key from a set of interchangeable keys wherein each interchangeable key has a keying feature compatible with a particular firearm rail, and wherein different ones of the interchangeable keys of the set thereof have keying features compatible with different firearm rails; and placing the selected interchangeable key into the key receptacle. The assembling a clamping mechanism may include: inserting a thumb screw through one of the first clamping member and the second clamping member, and engaging the thumb screw with the other of the first clamping member and the second clamping member. The method may further include: threading a shaft of the thumb screw into a threaded opening of the second clamping member; or threading the shaft of the thumb screw into a threaded opening of the second clamping member and installing a retainer thereto. The method may further comprise: operating the clamping mechanism to release the first and second clamping members from the firearm rail; removing the clamping mechanism; removing the first and second clamping members from the light body; selecting a different pair of first and second clamping members from the set of pairs of clamping members; and repeating for the different pair of first and second clamping members the steps recited in the first sentence of this paragraph in relation to the first and second clamping members.

As used herein, the term "about" means that dimensions, sizes, formulations, parameters, shapes and other quantities and characteristics are not and need not be exact, but may be approximate and/or larger or smaller, as desired, reflecting tolerances, conversion factors, rounding off, measurement error and the like, and other factors known to those of skill in the art. In general, a dimension, size, formulation, parameter, shape or other quantity or characteristic is "about" or "approximate" whether or not expressly stated to be such. It is noted that embodiments of very different sizes, shapes and dimensions may employ the described arrangements.

Although terms such as "front," "back," "rear," "side," "end," "top," "bottom," "up," "down," "left," "right," "upward," "downward," "forward," "backward," "under" and/or "over," "vertical," "horizontal," and the like may be used herein as a convenience in describing one or more embodiments and/or uses of the present arrangement, the articles described may be positioned in any desired orientation and/or may be utilized in any desired position and/or orientation. Such terms of position and/or orientation should be understood as being for convenience only, and not as limiting of the invention as claimed.

As used herein, the term "plurality" means plural, two or greater in number of whatever the term pertains to, i.e. or more than one. Further, the term "predetermined" as used herein means determined in advance or before hand, with respect to whatever the term pertains to. Either term may be used with respect to a physical object or thing and with respect to an intangible thing, e.g., a signal or data, and the like.

As used herein, the term "and/or" encompasses both the conjunctive and the disjunctive cases, so that a phrase in the form "A and/or B" encompasses "A" or "B" or "A and B" and a phrase in the form "A, B and/or C" includes "A," "B," "C," "A and B," "A and C," "B and C," and "A and B and C." In addition, the term "at least one of" one or more elements is intended to include one of any one of the elements, more than one of any of the elements, and two or more of the elements up to and including all of the elements, and so, e.g., phrases in the form "at least one of A, B and C" include "A," "B," "C," "A and B," "A and C," "B and C," and "A and B and C."

As used herein, the term "predetermined" means determined in advance and while that may include a fixed value, position, condition and/or limit, predetermined is not limited to a fixed value, position, condition and/or limit. A predetermined value, position, condition and/or limit may change or otherwise vary over time, over a sequence and/or over a randomized series of values, positions, conditions and/or limits.

A fastener as used herein may include any fastener or other fastening device that may be suitable for the described use, including threaded fasteners, e.g., bolts, screws and driven fasteners, as well as pins, rivets, nails, spikes, barbed fasteners, clips, clamps, nuts, speed nuts, cap nuts, acorn nuts, and the like. Where it is apparent that a fastener would be removable in the usual use of the example embodiment described herein, then removable fasteners would be preferred in such instances. A fastener may also include, where appropriate, other forms of fastening such as a formed head, e.g., a peened or heat formed head, a weld, e.g., a heat weld or ultrasonic weld, a braze, and adhesive, and the like.

As used herein, the terms "connected" and "coupled" as well as variations thereof may or may not be intended to be exact synonyms, but may also encompass some similar things and some different things. The term "connected" as indicated by its context may be used generally to refer to elements that have a direct electrical and/or physical contact to each other, whereas the term "coupled" as indicated by its context may be used generally to refer to elements that have an indirect electrical and/or physical contact with each other, e.g., via one or more intermediate elements, so as to cooperate and/or interact with each other, and may include elements in direct contact as well.

The term battery is used herein to refer to an electrochemical device comprising one or more electro-chemical cells and/or fuel cells, and so a battery may include a single cell or plural cells, whether as individual units or as a packaged unit. A battery is one example of a type of an electrical power source suitable for a portable or other device. Such devices could include power sources including, but not limited to, fuel cells, super capacitors, solar cells, and the like. Any of the foregoing may be intended for a single use or for being rechargeable or for both, and/or plural ones thereof may be combined into a battery pack or battery assembly.

Various embodiments of a battery may have one or more battery cells, e.g., one, two, three, or more battery cells, as may be deemed suitable for any particular device. A battery may employ various types and kinds of battery chemistry types, e.g., a carbon-zinc, alkaline, lead acid, nickel-cadmium (Ni—Cd), nickel-metal-hydride (NiMH) or lithium-ion (Li-Ion) battery type, of a suitable number of cells and cell capacity for providing a desired operating time and/or lifetime for a particular device, and may be intended for a single use or for being rechargeable or for both. Examples may include a three cell Ni—Cd or NiMH battery typically producing about 3.6 volts, a Li-Ion battery typically producing about 3.5 volts, or a two-cell Li-Ion battery typically producing about 7 volts, it being noted that the voltages produced thereby will be higher when approaching full charge and will be lower in discharge, particularly when providing higher current and when reaching a low level of charge, e.g., becoming discharged.

While the present invention has been described in terms of the foregoing example embodiments, variations within the scope and spirit of the present invention as defined by the claims following will be apparent to those skilled in the art. For example, as viewed by a user of the firearm, light 10 could be configured with fixed clamping member 52 on the left side of the firearm and light 10 and with movable clamping member 56 on the right side thereof, or alternatively, light 10 could be configured with fixed clamping member 52 on the right side of the firearm and light 10 and with movable clamping member 56 on the left side thereof.

Further, light body 20 of light 10 could be configured such that receptacles 252 and 256 are of the same size and shape with both having holes like holes 252H so that mounting arrangement 50, e.g., fixed clamping member 52, moveable clamping member 56 and clamping mechanism 54 can be mounted from either the left or right side of light 10 as a user might deem convenient.

Still further, clamping arrangement 50 could be configured such both clamping member 52 and clamping member are movable in their respective receptacles 252 and 256 and are retained therein and are movable by clamping mechanism 54.

Further yet, light 10 may be provided with a set of elements 52, 54, 56 of one clamping arrangement 50, or may be provided with plural sets of elements 52, 54, 56 of plural clamping arrangements 50, e.g., corresponding to different firearms and/or firearm rails, and/or additional sets of elements 52, 54, 56 may be available separately from light 10.

The respective bases 52B, 56B of fixed clamping member 52 and of movable clamping member 56 may be of any shape that restricts the upward and downward movement as well as the forward and rearward movement of clamping members 52, 56 in their respective receptacles 252, 256, while permitting their movement toward and away from one another. For example bases 52B, 56B may have opposing convex side surfaces while receptacles 252, 256 therefor have opposing concave surfaces complementary thereto. Alternatively, example bases 52B, 56B may have opposing concave side surfaces while receptacles 252, 256 therefor have opposing convex surfaces complementary thereto. Other shapes therefor, e.g., other predetermined or predefined shapes, that similarly restrict and permit movement of clamping members 52, 56 may also be employed.

Similarly and alternatively, light 10 may be provided with one interchangeable key 60, or may be provided with plural interchangeable keys 60, e.g., corresponding to different firearms and/or firearm rails, and/or additional interchangeable keys 60 may be available separately from light 10.

While the example embodiment of clamping mechanism has a clamping screw with a shaft passing through the fixed clamping member and engaging the movable clamping member, the threaded shaft of the clamping screw may be disposed through a hole in one of the fixed clamping member and the movable clamping member and engage a threaded hole in the other of the fixed clamping member and the movable clamping member. Other clamping mechanisms may be employed, e.g., ones having a lever or having a cam or having a nut, to tighten the clamping members on a firearm rail.

Clamping mechanism 54 may include a biasing element so as to bias movable clamping member 56 to move towards fixed clamping member 52, e.g., a circular spring disposed on shaft 54S between fixed clamping member 52 and the head 54H of clamping screw 54 or disposed on shaft 54S between movable clamping member 56 and the wall of receptacle 256. Alternatively, clamping mechanism 54 may include a biasing element so as to bias movable clamping member 56 to move away from fixed clamping member 52. Example biasing elements include, e.g., a helical spring, a wavy spring, stacked springs and the like.

While certain features may be described as a raised feature, e.g., a rib, ridge, boss, flange, projection, detent, or other raised feature, such feature may be positively formed or may be what remains after a recessed feature, e.g., a groove, slot, hole, indentation, recess, detent, or other recessed feature, is made. Similarly, while certain features may be described as a recessed feature, e.g., a groove, slot, hole, indentation, recess or other recessed feature, such feature may be positively formed or may be what remains after a raised feature, e.g., a rib, ridge, boss, flange, projection or other raised feature, is made. In addition, where a raised feature engages a recessed feature, such as a cylindrical projection that engages a complementary receptacle, the relative positions of the raised and recessed features may be interchanged or other wise modified.

Each of the U.S. Provisional Applications, U.S. Patent Applications, and/or U.S. Patents, identified herein is hereby incorporated herein by reference in its entirety, for any purpose and for all purposes irrespective of how it may be referred to or described herein.

Finally, numerical values stated are typical or example values, are not limiting values, and do not preclude substantially larger and/or substantially smaller values. Values in any given embodiment may be substantially larger and/or may be substantially smaller than the example or typical values stated.

What is claimed is:

1. A mountable light comprising:

a light body having a cavity for receiving a source of electrical power, having a pair of receptacles therein located on opposite sides of the light body for receiving respective clamping members therein;

wherein each of the pair of receptacles has a configuration including a base end that is larger than an opening thereof that is opposite the base end;

a light source supported by the light body for providing light;

a switch supported by the light body for selectively energizing the light source to produce light; and a set of clamping members including at least two pairs of clamping members wherein each pair of clamping members includes a fixed clamping member and a movable clamping member each having a base of the same configuration as the pair of receptacles of the light body and each having a rail interface feature compatible with the same firearm rail, and wherein different pairs of clamping members have different rail interface features compatible with different firearm rails;

a mounting arrangement on the light body including:

a fixed clamping member of a first pair of clamping members selected from the set of at least two pairs of clamping members, the fixed clamping member having its base removably disposed in a first of the pair of receptacles, the fixed clamping member having a rail interface extending from the base thereof, wherein the base thereof is larger than is the dimension thereof at a location intermediate the base end thereof and the rail interface thereof in substantially the same size and shape as a first of the pair of receptacles;

a fastener retaining the fixed clamping member in the first of the pair of receptacles;

a movable clamping member of the first pair of clamping members selected from the set of at least two pairs of clamping members, the movable clamping member being slidably disposed in a second of the pair of receptacles so as to be movable toward and away from the fixed clamping member, the movable clamping member having a rail interface extending from the base thereof, wherein the base thereof is larger than is the dimension thereof at a location intermediate the base end thereof and the rail interface thereof in substantially the same size and shape as the second of the pair of receptacles so that the movable clamping member is movable in the second of the pair of receptacles toward and away from the fixed clamping member; and a clamping mechanism coupled between the fixed clamping member and the movable clamping member for moving the movable clamping member toward and away from the fixed clamping member, wherein the fixed clamping member and the movable clamping member of the mounting arrangement on the light body are selected from the set of pairs of clamping members to interface with a particular firearm rail.

2. The mountable light of claim 1 wherein each of the pair of receptacles has a trapezoidal shape and wherein the respective bases of the fixed clamping member and the movable clamping member have substantially the same trapezoidal shape and size as each of the pair of receptacles.

3. The mountable light of claim 1 wherein the clamping mechanism comprises:

a clamping screw having a head and a threaded shaft, wherein the threaded shaft of the clamping screw is disposed through a hole in one of the fixed clamping member and the movable clamping member and engages a threaded hole in the other of the fixed clamping member and the movable clamping member.

4. The mountable light of claim 1 further comprising:

a removable key disposed in a key receptacle between the pair of receptacles, whereby the removable key is disposed between the fixed clamping member and the movable clamping member; and wherein the removable key is configured to interface with the firearm rail with which the fixed clamping member and the movable clamping member are compatible.

5. The mountable light of claim 4 further comprising:

a set of interchangeable keys wherein each interchangeable key has a base of the same configuration as the key receptacle for receiving a removable key and has a keying feature compatible with a particular firearm rail, and wherein different ones of the interchangeable keys of the set thereof have respective keying features compatible with different firearm rails, wherein the removable key is selected from the set of interchangeable keys.

6. A mountable light comprising:

a light body having forward and rearward ends, having a cavity for receiving a source of electrical power, and having a pair of receptacles therein located on first and second opposite sides of the light body, wherein each receptacle of the pair of receptacles has a predetermined shape;

a light source at the forward end of the light body for providing light;

an actuator at the rearward end of the light body for selectively energizing the light source to produce light; and a set of pairs of clamping members including at least two pairs of clamping members, wherein each pair of clamping members includes a first clamping member and a second clamping member each having a base of the predetermined shape and each having a rail interface feature compatible with the same firearm rail, and wherein different pairs of clamping members have different rail interface features compatible with different firearm rails, a mounting arrangement on an upward side of the light body comprising:

a pair of clamping members including a first clamping member and a second clamping member selected from the set of pairs of clamping members each having a base of the predetermined shape and a rail interface feature;

wherein the predetermined shape of the base of each of the first and second clamping members is complementary to the predetermined shape of each receptacle of the pair of receptacles, and wherein the respective predetermined shapes of the bases of the first and second clamping members and of each receptacle of the pair of receptacles restricts the upward and downward movement and the forward and rearward movement of the first and second clamping members in their respective receptacles relative to the light body while permitting movement of the first and second clamping members toward and away from one another; and a clamping mechanism coupled between the first and second clamping members for moving the first and second clamping members toward and away from each other, wherein the first and second clamping members of the mounting arrangement on the light body are selected from the set of pairs of clamping members to interface with a particular firearm rail.

7. The mountable light of claim 6 wherein the base of each of the first and second clamping members has a dimension at a base end thereof that is larger than is the dimension thereof at a location intermediate the base end thereof and the rail interface of the first and second clamping members in substantially the same shape and size as each of the pair of receptacles.

8. The mountable light of claim 6 wherein each of the pair of receptacles has a trapezoidal shape and wherein the respective bases of the first and second clamping members have substantially the same trapezoidal shape and size as each of the pair of receptacles.

9. The mountable light of claim 6 wherein the clamping mechanism comprises:

a clamping screw having a head and a threaded shaft, wherein the threaded shaft of the clamping screw is disposed through a hole in one of the first and second clamping members and engages a threaded hole in the other of the first and second clamping members.

10. The mountable light of claim 6 wherein the first clamping member is fastened to the light body to be retained in a first of the pair of receptacles thereof, and wherein the second clamping member is movable toward and away from the first clamping member.

11. The mountable light of claim 6 further comprising:

a removable key removably disposed in a key receptacle of the light body between the first and second clamping members;

wherein the removable key is selected to interface with the same particular firearm rail as are the first clamping member and the second clamping member.

12. The mountable light of claim 11 further comprising:

a set of interchangeable keys wherein each interchangeable key has a base of the same configuration and has a keying feature compatible with a particular firearm rail, and wherein different ones of the interchangeable keys of the set thereof have respective keying features compatible with different firearm rails, wherein the removable key is selected from the set of interchangeable keys.

13. A mountable light comprising:

a light body having forward and rearward ends and a longitudinal axis therebetween, having a cavity for receiving a source of electrical power, and having a pair of receptacles therein located on first and second opposite sides of the light body, wherein each receptacle of the pair of receptacles has a predetermined shape;

a light source on the light body for providing light;

an actuator on the light body for selectively energizing the light source to produce light;

a set of pairs of clamping members including at least two pairs of clamping members, wherein each pair of clamping members includes a first clamping member and a second clamping member each having a base of the predetermined shape and each having a rail interface feature compatible with the same firearm rail, and wherein different pairs of clamping members have different rail interface features compatible with different firearm rails, a mounting arrangement on a side of the light body comprising:

a pair of clamping members including a first clamping member and a second clamping member selected from the set of pairs of clamping members each having a base of the predetermined shape and a rail interface feature;

wherein the predetermined shape of the base of each of the first and second clamping members is complementary to the predetermined shape of each receptacle of the pair of receptacles, and wherein the respective predetermined shapes of the bases of the first and second clamping members and of each receptacle of the pair of receptacles restricts movement of the first and second clamping members in their respective receptacles in directions parallel to and transverse to the longitudinal axis of the light body except in a direction wherein the first and second clamping members move toward and away from one another; and a clamping mechanism coupled between the first and second clamping members for moving the first and second clamping members toward and away from each other, wherein the first and second clamping members of the mounting arrangement on the light body are selected from the set of pairs of clamping members to interface with a particular firearm rail.

14. The mountable light of claim 13 wherein the base of each of the first and second clamping members has a dimension at a base end thereof that is larger than is the dimension thereof at a location intermediate the base end thereof and the rail interface of the first and second clamping members in substantially the same shape and size as each of the pair of receptacles.

15. The mountable light of claim 13 wherein each of the pair of receptacles has a trapezoidal shape and wherein the respective bases of the first and second clamping members have substantially the same trapezoidal shape and size as each of the pair of receptacles.

16. A method for assembling a mountable light comprising:

obtaining a light body having a pair of opposing receptacles of predetermined retaining shape;

obtaining a set of pairs of clamping members including at least two pairs of clamping members, wherein each pair of clamping members includes a first clamping member and a second clamping member each having a base of the predetermined retaining shape and each having a rail interface feature compatible with the same firearm rail, and wherein different pairs of clamping members have different rail interface features compatible with different firearm rails;

selecting from the set of pairs of clamping members a pair of clamping members including first and second clamping members each having a base of the predetermined retaining shape and each having a rail interface feature, wherein the respective rail interface features correspond to features of a particular firearm rail;

inserting the first clamping member with its base in a first of the pair of opposing receptacles;

inserting the second clamping member with its base in a second of the pair of opposing receptacles;

assembling a clamping mechanism with the first and second clamping members for moving the first and second clamping closer to and farther apart from each other;

placing the light body adjacent a firearm rail with the firearm rail between the first and second clamping members; and operating the clamping mechanism to clamp the firearm rail between the respective rail interface features of the first and second clamping members.

17. The method of claim 16 further comprising:

fastening the base of the first clamping member in the first of the pair of opposing receptacles of the light body.

18. The method of claim 16 wherein the light body has a key receptacle between the pair of opposing receptacles, the method further comprising:

selecting an interchangeable key having a key base configured to be placed into the key receptacle and a keying feature compatible with the firearm rail; and prior to the assembling a clamping mechanism, placing the selected interchangeable key into the key receptacle.

19. The method of claim 16 wherein the light body has a key receptacle between the pair of opposing receptacles, the method further comprising:

selecting an interchangeable key from a set of interchangeable keys wherein each interchangeable key has a keying feature compatible with a particular firearm rail, and wherein different ones of the interchangeable keys of the set thereof have keying features compatible with different firearm rails; and placing the selected interchangeable key into the key receptacle.

20. The method of claim 16 wherein the assembling a clamping mechanism includes:

inserting a thumb screw through one of the first clamping member and the second clamping member, and engaging the thumb screw with the other of the first clamping member and the second clamping member.

21. The method of claim 20 further including:

threading a shaft of the thumb screw into a threaded opening of the second clamping member; or threading the shaft of the thumb screw into a threaded opening of the second clamping member and installing a retainer thereto.

22. The method of claim 16 further comprising:

operating the clamping mechanism to release the first and second clamping members from the firearm rail;

removing the clamping mechanism;

removing the first and second clamping members from the light body;

selecting a different pair of first and second clamping members from the set of pairs of clamping members; and repeating for the different pair of first and second clamping members the steps recited in claim 16 in relation to the first and second clamping members.

* * * * *